US007325898B2

(12) United States Patent
Kawazoe et al.

(10) Patent No.: US 7,325,898 B2
(45) Date of Patent: Feb. 5, 2008

(54) RECORDING APPARATUS

(75) Inventors: Kenji Kawazoe, Kanagawa (JP); Kazuhiko Takahashi, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1025 days.

(21) Appl. No.: 10/607,341

(22) Filed: Jun. 27, 2003

(65) Prior Publication Data

US 2004/0051917 A1 Mar. 18, 2004

(30) Foreign Application Priority Data

Jul. 10, 2002 (JP) ..... 2002-201651

(51) Int. Cl.
*B41J 29/393* (2006.01)

(52) U.S. Cl. ..... 347/19; 347/9; 347/5

(58) Field of Classification Search ..... 347/19, 347/9, 16, 5, 85, 86; 400/61, 342

See application file for complete search history.

(56) References Cited

U.S. PATENT DOCUMENTS 5,127,752 A 7/1992 Courtney ..... 400/342
5,255,987 A 10/1993 Mizuno et al. ..... 400/61

FOREIGN PATENT DOCUMENTS

EP 0 713 780 5/1996

*Primary Examiner*—Lam Son Nguyen
(74) *Attorney, Agent, or Firm*—Fitzpatrick, Cella, Harper & Scinto

(57) ABSTRACT

A recording apparatus for recording on a recording material with a recording unit includes a carriage unit having a carriage that moves relative to the recording material. The carriage mounts the recording unit, which records an image on the recording material, and an adjustment head that includes an adjustment sensor, and a detection sensor is provided on the carriage to detect a position of the recording material. An offset amount is determined between a detected position detected by the detection sensor and a correct position by reading a common mark with the adjustment sensor of the adjustment head and the detection sensor. The recording unit records an image at a corrected position on the recording material based on the determined offset amount.

5 Claims, 26 Drawing Sheets

RECORDING APPARATUS

BACKGROUND OF THE INVENTION

1. Field of the Invention

The present invention relates to a recording apparatus such as a printer or image forming apparatus that can employ a tray loaded with a recording material.

2. Related Background Art

Various recording materials have been proposed for recording by a recording apparatus such as a printer or image forming apparatus. Among those, there are small-sized, thick, recording materials like a CD-R, a DVD, and a card (hereinafter collectively referred to as CD (compact disc)). In current general recording apparatuses, the use of a transport path for a single sheet of paper in recording on such a recording material such as a CD is likely to cause inconveniences including poor transportation performance and scarring which are due to high rigidity of the CD and, in worst cases, the CD cannot be transported at all because the distance between transport rollers is too narrow for the CD. Accordingly, when transporting a small-sized, thick, recording material such as a CD, the recording material is put on a tray and the tray is transported through a path different from the transport path for a single sheet of paper.

In using the above tray, which is thicker than a general, single sheet of paper, it is necessary to put a fair amount of considerations on insertion of the tray into a transport roller pair, the nipping of the tray by the transport roller pair, appropriateness of the gap between recording means (recording head) and the recording material, and the like. One measure to meet the need is to provide the recording apparatus with an operation lever so that the pressure on the transport rollers and other transport members is released in conjunction with the motion of the operation lever. In this case, a user positions the tray by inserting the tray until it reaches a given position, and operates the operation lever to set the transport members into the pressured state once more. Then the user operates the operation lever to raise a carriage mounted with the recording head to a level that provides a proper gap between the recording material and the recording head.

In recording (printing) on such a recording material as a CD, the position of the CD or such recording material may not be detected or a sensor mounted on a carriage may be used to directly detect the position of a while portion in a recordable range of the CD. When detection of the position of the recording material is not included, an image may be recorded in a wrong portion of the CD or such recording material and therefore a user has to adjust the recording apparatus by running an application program or the like on a personal computer. For that reason, using a sensor (e.g., tray position detection sensor) mounted on a carriage to detect the position of a recording material for recording has lately become a frequently employed method.

However, the method which uses a sensor mounted on a carriage to detect the position of such a recording material such as a CD needs the sensor and a recording head which is recording means to be in their correct positions in order to record at the right point on the recording material. This means that the sensor has to be attached with accuracy and, to improve the accuracy, the parts have to have shapes and dimensions of improved precision and have to be assembled with extreme accuracy. As a result, the cost is increased.

SUMMARY OF THE INVENTION

The present invention has been made in view of the above, and an object of the present invention is to provide a recording apparatus which can readily and accurately adjust the position of recording means in relation to a sensor mounted on a carriage through a simple structure and simple control and which can record at the right point on a recording material such as a CD by properly correcting the recording position.

According to the present invention, a recording apparatus for recording on a recording material with recording means, includes:

- a transport (conveying) roller for transporting (conveying) the recording material;
- a carriage moved in a direction that crosses a recording material transporting (conveying) direction while being mounted with the recording means;
- a first detecting means placed on the carriage to detect a position of the recording material;
- adjusting means for measuring a position of the first detecting means and calculating a difference between the detected position and a predetermined position; and
- control means for controlling a position of recording by the recording means using the calculation result of the adjusting means.

Also, according to the present invention, a recording apparatus for recording on a recording material with recording means, includes:

- a transport (conveying) roller for transporting (conveying) the recording material;
- a carriage moved in a direction that crosses a recording material transporting (conveying) direction while being mounted with the recording means;
- detecting means placed on the carriage to detect a position of the recording material;
- detection subject means placed inside the recording apparatus;
- adjusting means for calculating a difference between a position of the detection subject means which is detected by the detecting means and a predetermined position; and
- control means for controlling a position of recording by the recording means using the calculation result of the adjusting means.

According to the present invention, a recording apparatus is provided which can readily and accurately adjust the position of recording means in relation to a sensor mounted on recording means moving means through a simple structure and simple control and which can record at the right point on a recording material such as a CD by properly correcting recording position misalignment.

DETAILED DESCRIPTION OF THE PREFERRED EMBODIMENTS

Specific descriptions will be given below on embodiments of the present invention with reference to the accompanying drawings. Throughout the drawings, identical or corresponding components are denoted by the same symbols.

First Embodiment

Figure 1:
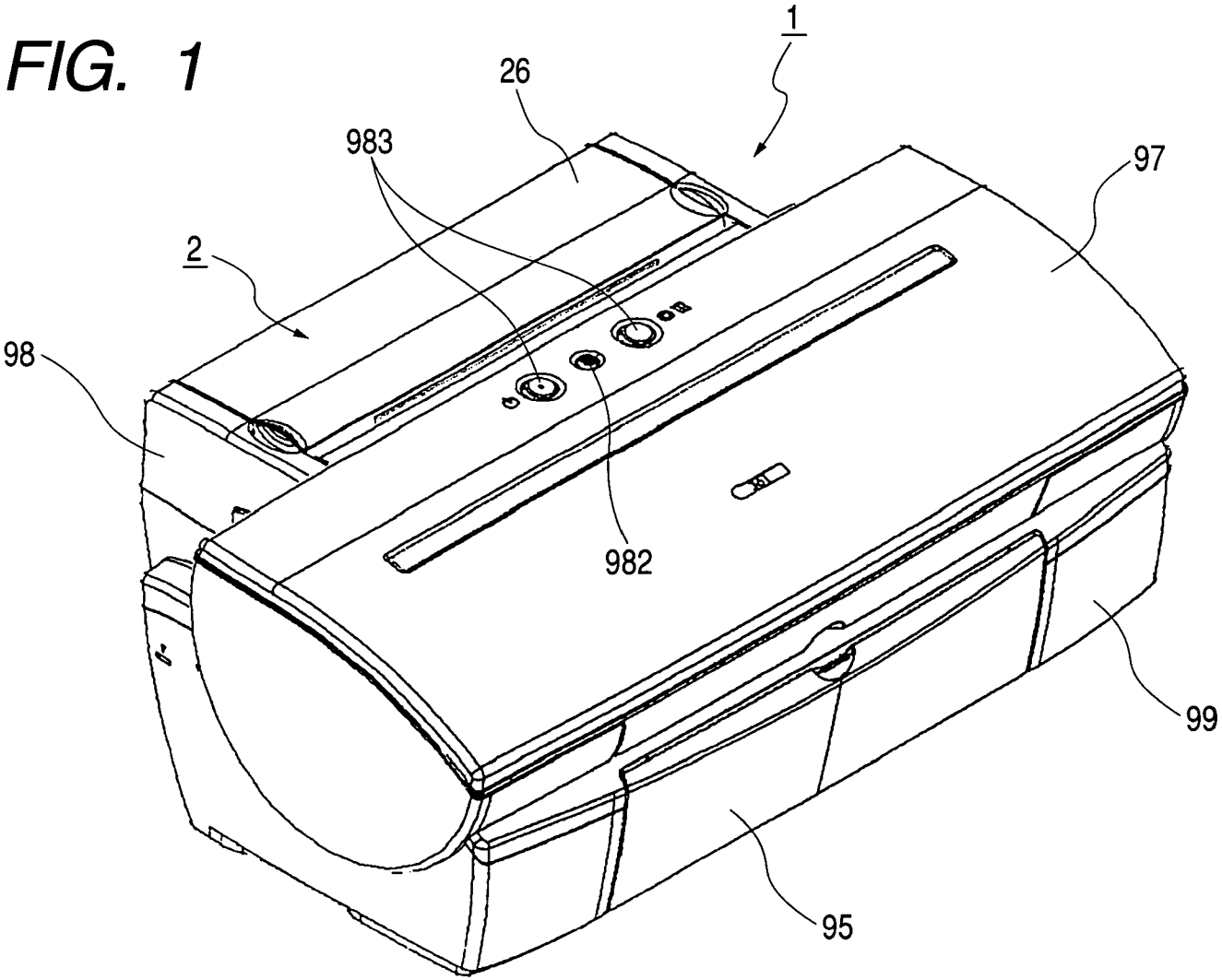
FIG. 1 is a perspective view showing an embodiment of a recording apparatus to which the present invention is applied.
Figure 2:
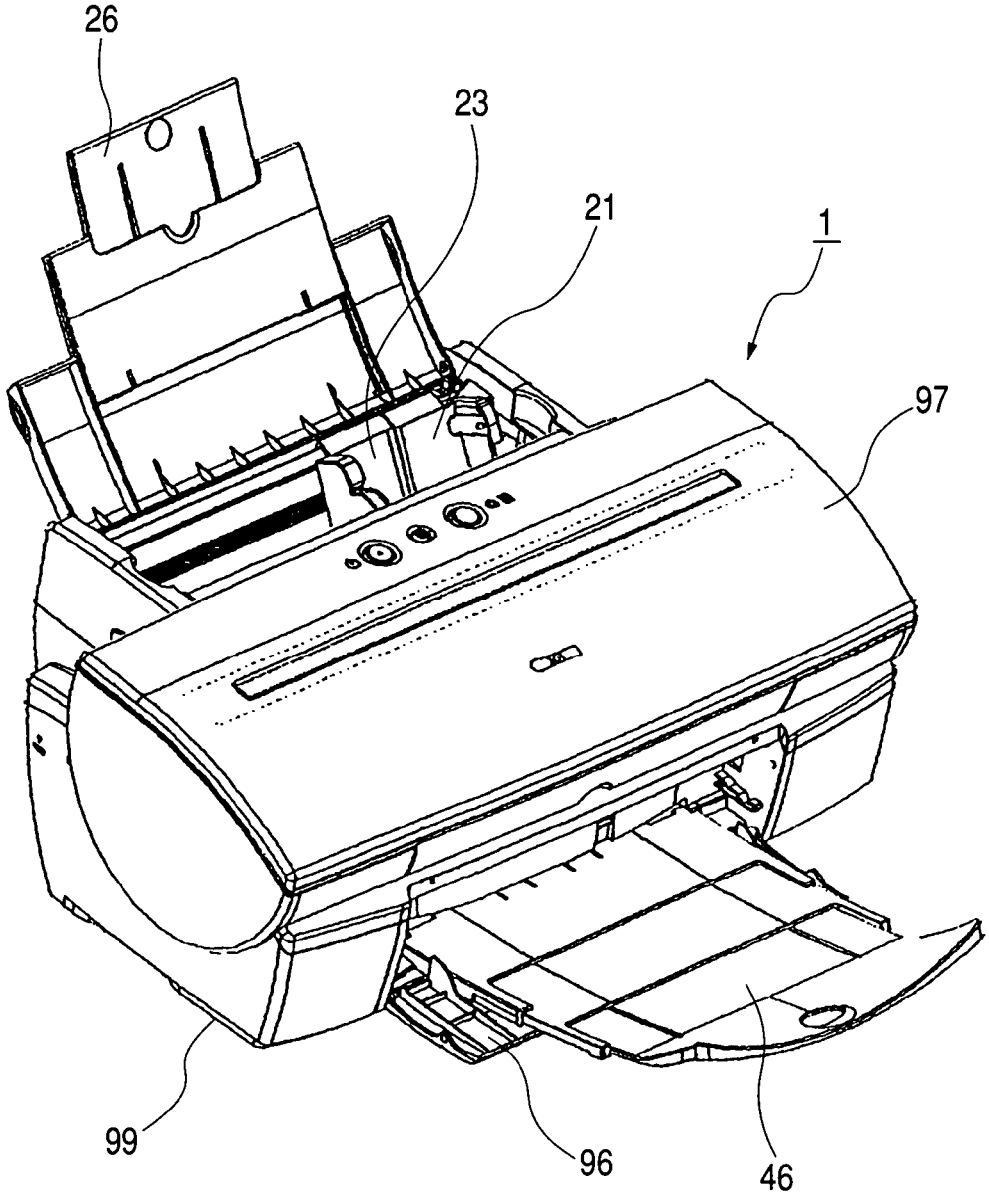
FIG. 2 is a perspective view of the recording apparatus of FIG. 1 with its sheet feeding tray and sheet delivery tray opened.
Figure 3:
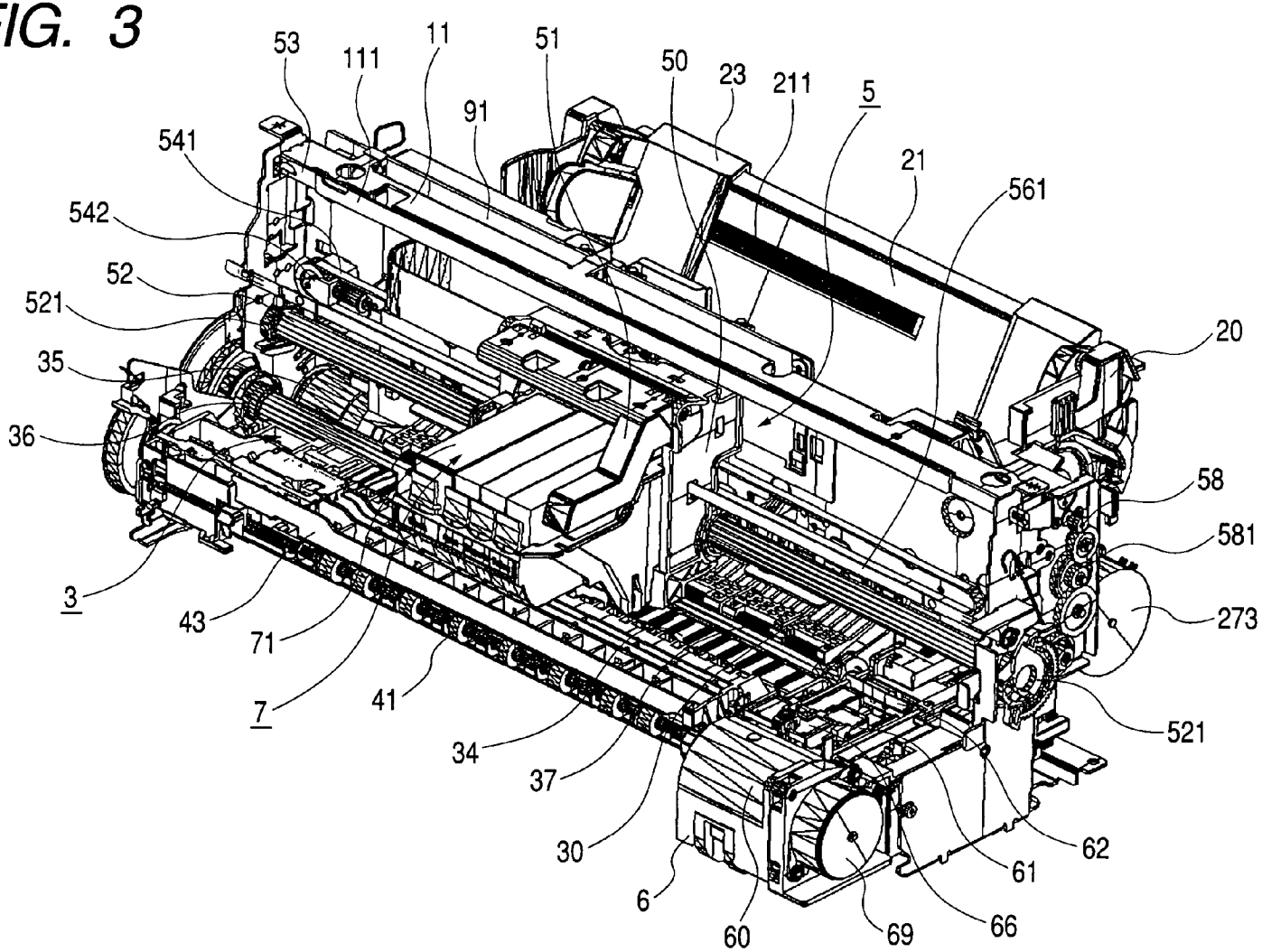
FIG. 3 is a perspective view from the front right angle of an internal mechanism in an embodiment of a recording apparatus to which the present invention is applied.
Figure 4:
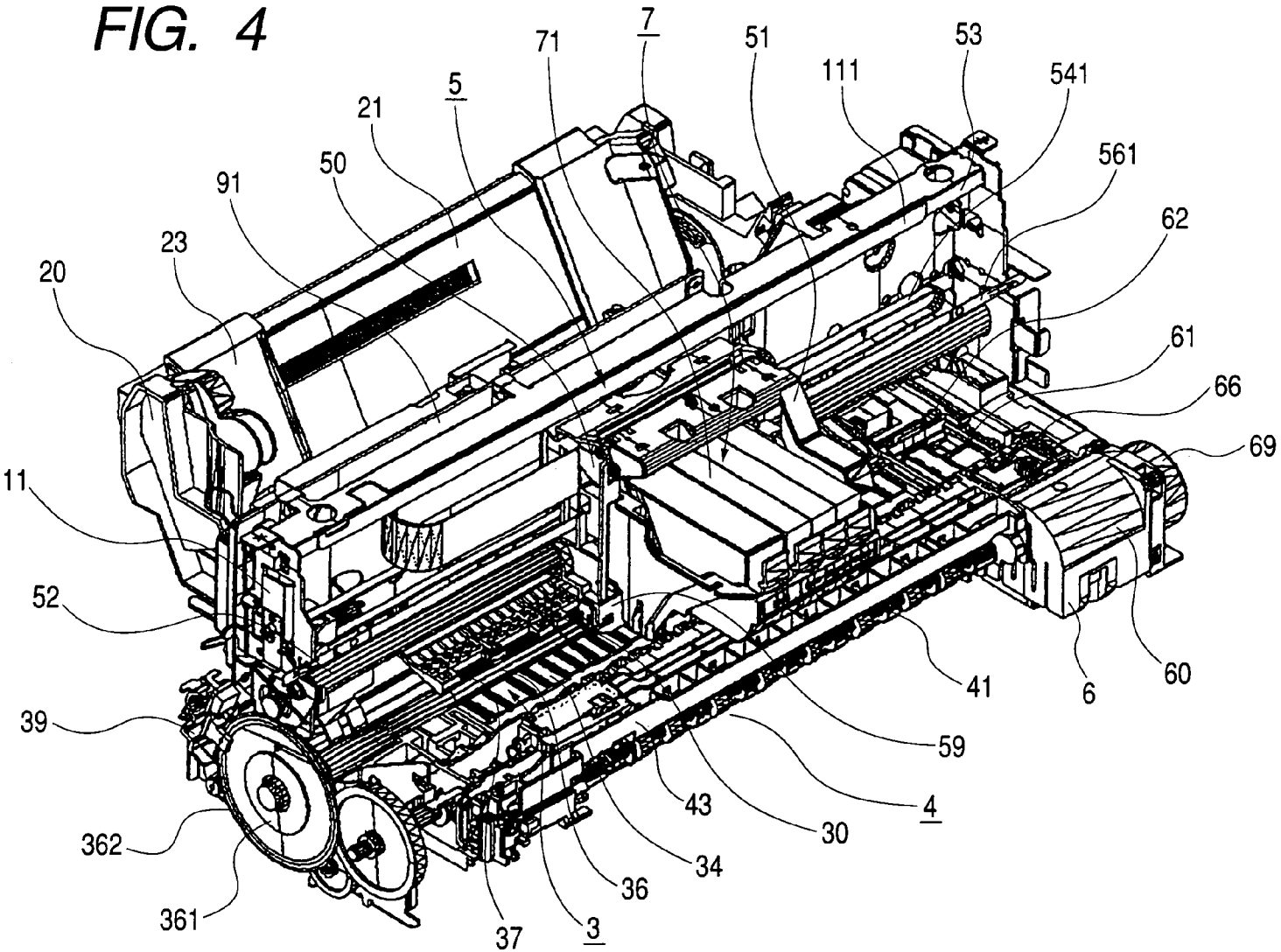
FIG. 4 is a perspective view from the front left angle of the internal mechanism of the recording apparatus of FIG. 3.
Figure 5:
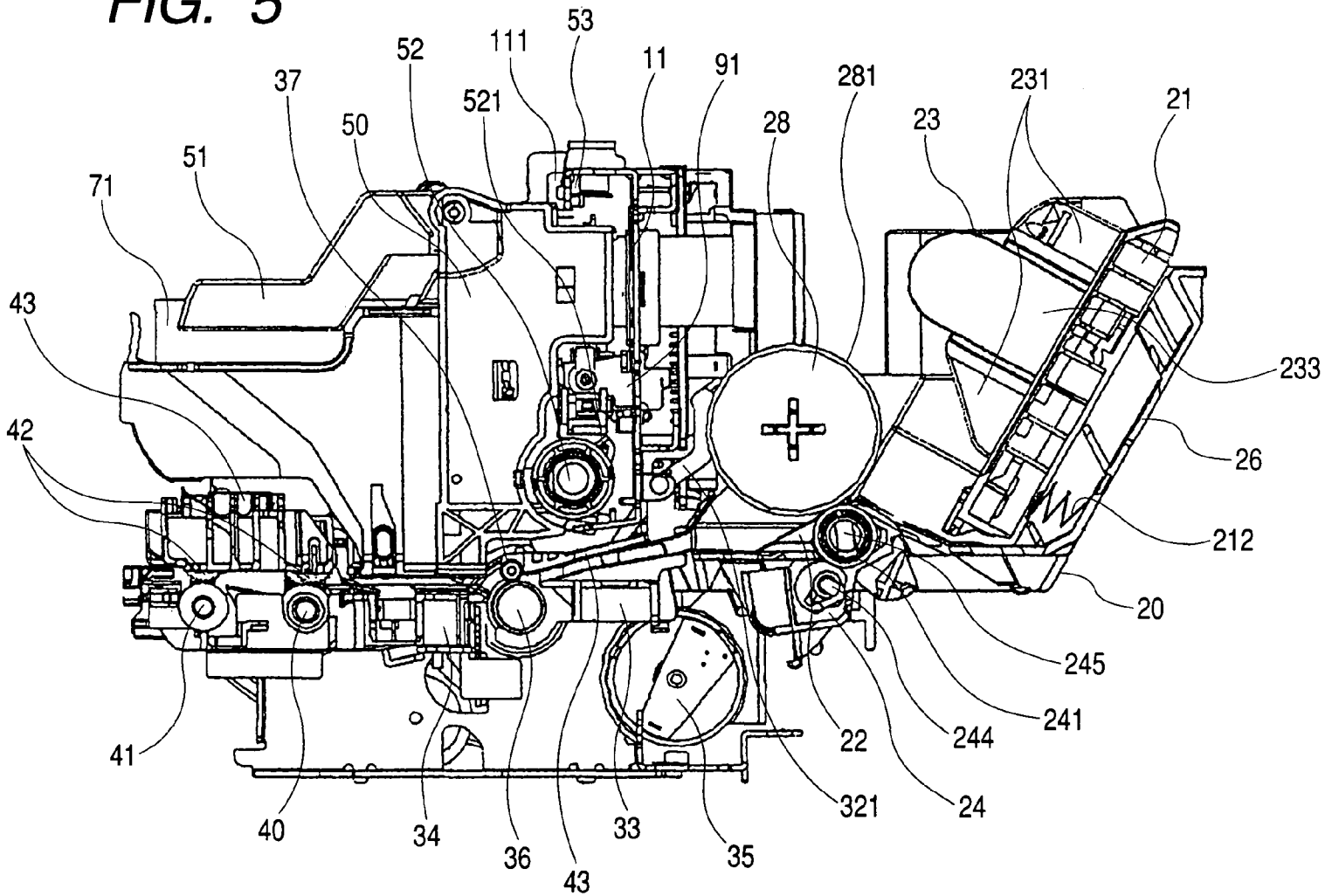
FIG. 5 is a vertical sectional view of the recording apparatus of FIG. 3.
Figure 6A:
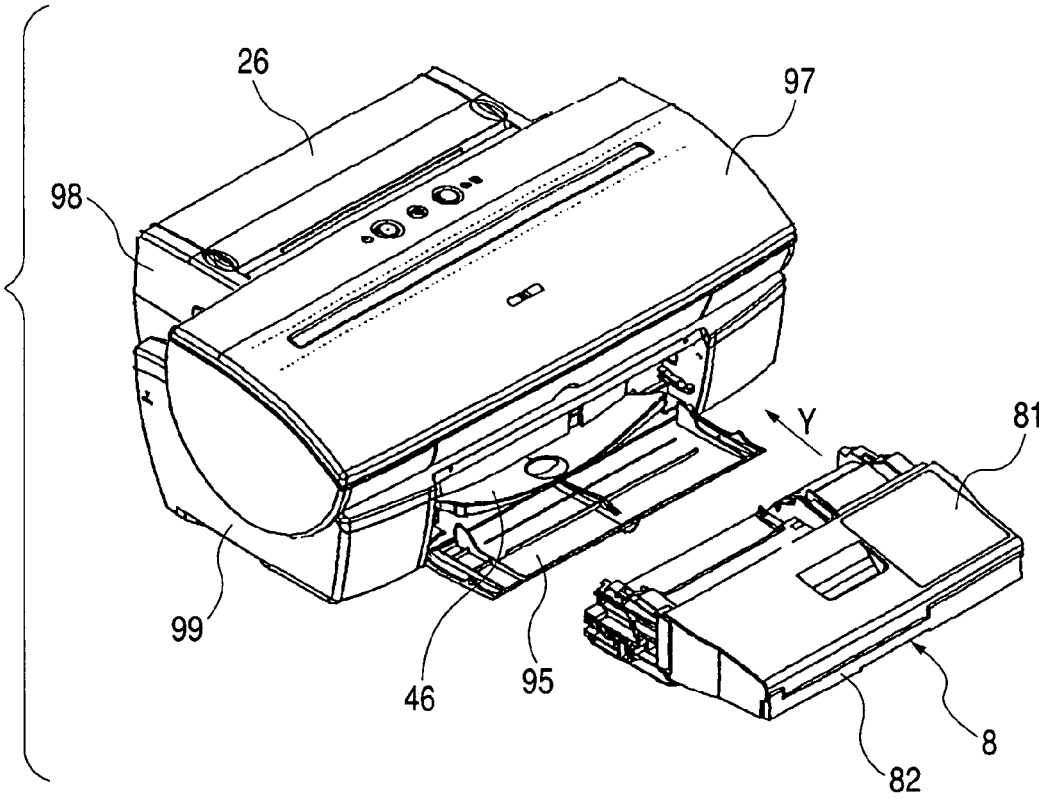
FIGS. 6A and 6B are perspective views showing the recording apparatus of FIG. 1 before and after a CD transporting unit is attached.
Figure 6B:
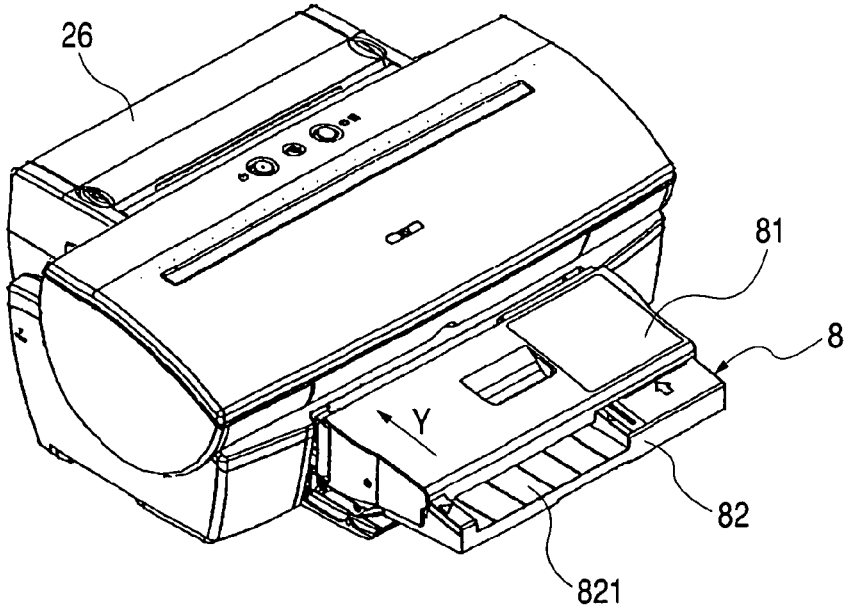
Figure 7:
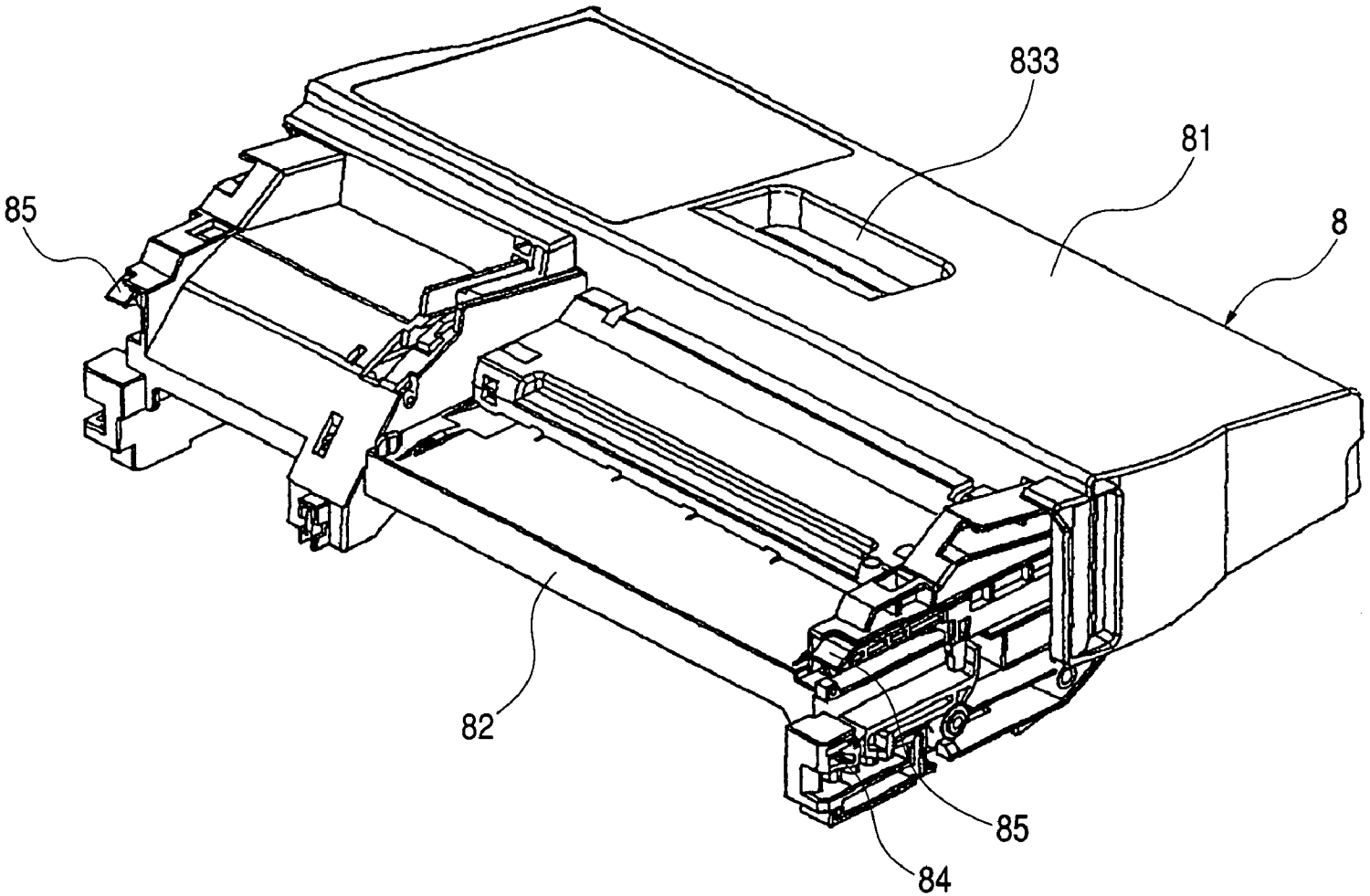
FIG. 7 is a perspective view showing a CD transporting unit attachable to the recording apparatus of FIG. 1.

FIG. 1 is a perspective view showing an embodiment of a recording apparatus to which the present invention is applied, and FIG. 2 is a perspective view of the recording apparatus of FIG. 1 with its sheet feeding tray and sheet delivery tray opened. FIG. 3 is a perspective view from the front right angle of the internal mechanism in the recording apparatus of FIG. 1, FIG. 4 is a perspective view from the front left angle of the internal mechanism of the recording apparatus of FIG. 3, and FIG. 5 is a vertical sectional view of the recording apparatus of FIG. 3. FIGS. 6A and 6B are perspective views showing the recording apparatus of FIG. 1 before and after a CD transporting unit 8 is attached, respectively, and FIG. 7 is a perspective view showing the CD transporting unit 8 attachable to the recording apparatus of FIG. 1. FIGS. 8 to 19 are views each showing a configuration and an operation for CD printing in an embodiment of a recording apparatus to which the present invention is applied.

In FIGS. 1 to 5, a recording apparatus 1 according to this embodiment has a sheet feeding unit 2, a sheet transporting (conveying) unit 3, a sheet delivery unit 4, a carriage unit (recording means moving means) 5, a recovery mechanism (cleaning unit) 6, recording means (recording head) 7, a CD transporting unit 8, and an electricity unit 9. Those components are outlined below separately and sequentially.

(A) Sheet Feeding Unit

The sheet feeding unit 2 is composed of a base 20 to which a pressure plate 21, a feeding roller 28, a separating roller 241, a return lever 22, etc. are attached (FIG. 5). The pressure plate 21 is for loading a sheet material P. The feeding roller 28 is for feeding the sheet material P. The separating roller 241 separates one sheet of the sheet material P from another. The return lever 22 is for returning the sheet material P to the loading position. A sheet feeding tray 26, which is for holding the loaded sheet material P, is attached to the base 20 or to an exterior package of the recording apparatus. The sheet feeding tray 26 is of a multistage type as shown in FIG. 2, and is pulled out when in use.

The sheet feeding roller 28 is a rod that is shaped like an arc in section. A sheet feeding roller rubber band 281 is placed on the sheet feeding roller 28 at a point close to the sheet reference. A sheet material is fed (sent) by such sheet feeding roller 28. The sheet feeding roller 28 is driven by a driving force transmitted through a driving force transmitting gear 271 and a planet gear 272 from a sheet feeding motor 273, which is provided in the sheet feeding unit 2. The pressure plate 21 has a movable side guide 23 to regulate the loading position of the sheet material P. The pressure plate 21 can rotate about a rotation axis coupled to the base 20, and is biased toward the sheet feeding roller 28 by a pressure plate spring 212. A portion of the pressure plate 21 that faces the sheet feeding roller 28 is provided with a separating sheet 213 formed of a material that has a large friction coefficient, such as synthetic leather, so as not to feed several upper sheets of the stack of the loaded sheet material P at once. The pressure plate 21 is structured such that it can be pressed against or distanced from the sheet feeding roller 28 by a pressure plate cam 214.

The base 20 also has a separating roller holder 24 attached thereto. The separating roller 241 for separating one sheet of the sheet material P from the rest is attached to the separating roller holder 24. The separating roller holder 24 can rotate about the rotation axis coupled to the base 20 and is biased toward the sheet feeding roller 28 by a separating roller spring 242. A separating roller clutch (clutch spring) 243 is attached to the separating roller 241, so that the portion where the separating roller 241 is attached is rotated when a given load or more is applied to the separating roller 241. The separating roller 241 is structured such that it is pressed against and distanced from the sheet feeding roller 28 by a separating roller release shaft 244 and a control cam 25. Positions of the pressure plate 21, the return lever 22, and the separating roller 241 are detected by an ASF sensor 29. The return lever 22 for returning the sheet material P to the loading position is rotatably attached to the base 20, and is biased in an unlocking direction by a return lever spring 221. In returning the sheet material P to the loading position, the return lever 22 is rotated by the control cam 25.

How a sheet of paper is fed using the above structure is described below. In a usual stand-by state, the pressure plate 21 is released by the pressure plate cam 214, the separating roller 241 is released by the control cam 25, and the return lever 22 is in a position which returns the sheet material P to the loading position and which blocks the loading port in order to prevent the sheet material P from accidentally entering the interior of the recording apparatus upon loading. Sheet feeding is started from this state and the first step is to bring the separating roller 241 into contact with the sheet feeding roller 28 by driving the motor. Then the return lever 22 is released to press the pressure plate 21 against the sheet feeding roller 28. Now, actual feeding of the sheet material P is, started. Only a given number of sheets of the sheet material P are sent to a nip portion constituted of the sheet feeding roller 28 and the separating roller 241 by regulation of an upstream separating unit 201, which is provided in the base 20. The sheet material P sent to the nip portion is separated there from one another and the topmost sheet alone is transported (fed). forward.

When the sheet material P reaches a transport roller pair constructed by a transport roller 36 and pinch rollers 37 which will be described later, the pressure plate 21 and the separating roller 241 are released by the pressure plate cam 214 and the control cam 25, respectively. The control cam 25 also returns the return lever 22 to the loading position. At this point, the sheet material P which has reached the nip portion between the sheet feeding roller 28 and the separating roller 241 becomes ready to return to the loading position.

(B) Sheet Transporting Unit

The sheet transporting unit 3 is attached to a chassis 11, which is obtained by bending and pulling a steel plate up. The sheet transporting unit 3 has the transport (conveying) roller 36 for transporting the sheet material P and a PE sensor 32. The transport roller 36 is a metal axis coated with fine ceramic particles and is attached to the chassis 11 by resting its metal portion on each end in a bearing 38. A transport roller tension spring 381 is provided between the bearing 38 and the transport roller 36, so that a given load is applied by biasing the transport roller 36. The load applied to the transporting roller 36 during rotation makes stable transportation possible.

The pinch rollers 37 are driven rollers and are in contact with the transport roller 36. The pinch rollers 37 are held by a pinch roller holder 30 and pressed against the transport roller 36 by a pinch roller spring 31 to generate a force to transport the sheet material P. The pinch roller holder 30 rotates about its rotation axis, which is held in a bearing of the chassis 11. A paper guide flapper 33, which guides the sheet material P, and a platen 34 are provided at an entrance of the sheet transporting unit 3 to which the sheet material P is transported. The pinch roller holder 30 has a PE sensor lever 321 for relaying detection of the front end and rear end of the sheet material P to the PE sensor 32. The platen 34 is positioned when it is attached to the chassis 11. The paper guide flapper 33 can rotate about a bearing unit 331 which makes a sliding motion while engaged with the transport roller 36. The paper guide flapper 33 is positioned when it is pressed against the chassis 11.

A sheet holding-down member 341 which covers an end of the sheet material P is provided on the sheet reference side of the platen 34. The sheet holding-down member 341 prevents the end of the sheet material P from interfering with a carriage 50 or the recording head 7 overhead even when the end of the sheet material P is misshapen or curled. The recording head 7 for forming an image based on image information is on the downstream side in the sheet material transporting direction of the transport roller 36. In the above structure, the sheet material P sent to the sheet transporting unit 3 is guided by the pinch roller holder 30 and the paper guide flapper 33 to be sent into a roller pair consisting of the transport roller 36 and the pinch rollers 37. At this point, the front end of the transported sheet material P is detected by the PE sensor lever 321 to determine the recording position (printing position or image formation position) in the sheet material P. The sheet material P is transported over the surface of the platen 34 as the roller pair, namely, the rollers 36 and 37 are rotated by a transport motor 35. Ribs collectively serving as a transport reference face are formed on the surface of the platen 34. The ribs are for management of a gap between the platen 34 and the recording head 7 as well as for preventing, together with the sheet delivery unit which is described later, the sheet material P from becoming too wavy by controlling waviness of the sheet material P.

The transport roller 36 is driven by transmitting the rotational force of the transport (conveying) motor 35, which is a DC motor, through a timing belt to a pulley 361 provided on the axis of the transport roller 36. A code wheel 362 is also provided on the axis of the transport roller 36 to detect how far the sheet material P is transported by the transport roller 36. Markings are formed on the code wheel 362 at a pitch of 150 lpi to 300 lpi. The markings are read by an encoder sensor 39 attached to a portion of the chassis 11 that is adjacent to the code wheel 362.

Employed as the recording means (recording head) 7 is an ink jet recording head. Separate, exchangeable, ink tanks containing ink of different colors are attached to the recording head 7. The recording head 7 can heat the ink by a heater (heater element) or the like in accordance with recording data. As the ink reaches film boiling from the heating, air bubbles grow or shrink to cause a change in pressure. The pressure change causes the ink to jet out of a discharge port of the recording head 7 and the jetted ink drops form an image on the sheet material P.

(C) Carriage Unit

The carriage unit 5 has the carriage 50 as recording means transporting means for moving the recording head 7, which is the recording means, in a direction that crosses the recording material transporting direction. The carriage 50 is guided and supported by a guide shaft 52 and a guide rail 111, which are placed in the direction that is at right angles with the sheet material P transporting direction, in a manner that allows the carriage 50 to move back and forth in a main scanning direction. The guide rail 111 also has a function of keeping the gap between the recording head 7 and the sheet material P to an appropriate value by holding the rear end of the carriage 50. The guide shaft 52 is attached to the chassis 11 whereas the guide rail 111 and the chassis 11 are an integral body. In order to reduce the noise of sliding, a sliding sheet 53, which is a thin plate of SUS or the like, is placed along a side of the guide rail 111 against which the carriage 50 slides.

The carriage unit 5 (carriage 50) is driven by a carriage motor 54, which is attached to the chassis 11, through a timing belt 541. The timing belt 541 is stretched and supported by an idle pulley 542. The timing belt 541 is linked to the carriage 50 through a dumper 55 made of rubber or the like. This attenuates vibration of the carriage motor 54 and others and resultantly nonuniformity in a printed image is reduced. The position of the carriage 50 is detected by a code strip 561, which is marked at a pitch of 150 lpi to 300 lpi and which is in parallel to the timing belt 541. The markings on the code strip 561 are read by an encoder sensor 56, which is provided on a carriage substrate 92 mounted to the carriage 50. The carriage substrate 92 also has a contact 921 for electrical connection with the recording head 7. The carriage 50 has a flexible substrate 57 for transmitting a head signal from the electricity unit (electric substrate) 9 to the recording head 7.

In order to fix the recording head 7 as the recording means to the carriage 50, the carriage 50 is provided with a bumping portion 501 for positioning and depressing means (head depressing means) 511 for depressing and fixing the recording head 7. The depressing means 511 is mounted to a head set lever 51, and rotates with the head set lever 51 about a rotation fulcrum to depress and set the recording head 7. The guide shaft 52 has on its ends an eccentric cam R (right hand eccentric cam) 521 and an eccentric cam L (left hand eccentric cam) 522. The driving force of a carriage lift motor 58 is transmitted through a gear train 581 to the eccentric cam 521 to lift and lower the guide shaft 52. As the guide shaft 52 is lifted or lowered, the carriage 50 is similarly lifted or lowered to set an appropriate gap between the carriage 50 and the sheet material P irrespective of the thickness of the sheet material P.

Also attached to the carriage 50 is a tray position detection sensor 59, which is a reflective photosensor to detect position detection marks 834 of a CD printing tray 83 for recording (printing) in a display portion of a small-sized, thick, recording material such as a CD-R. The tray position detection sensor 59 detects the position of the tray 83 upon receiving light that is emitted from a light emitting element and then reflected. In forming an image on the sheet material P with the above structure, the roller pair (the transport roller 36 and the pinch rollers 37) transports the sheet material P to the position where a row is to be recorded (a point in the sheet material P transporting direction) while the carriage motor 54 moves the carriage 50 to the recording (image formation) position (a point in a direction perpendicular to the sheet material P transporting direction) until the recording head 7 faces the recording position (image formation position). Then, upon receiving a signal from the electricity unit (electric substrate) 9, ink jets out of the recording head 7 toward the sheet material P for recording (image formation).

(D) Sheet Delivery Unit

The sheet delivery unit 4 is equipped with two sheet delivery rollers 40 and 41, spurs 42 which are driven and rotated when pressed against the delivery rollers 40 and 41 under a given pressure, and a gear train for transmitting the driving force of the transport roller 36 to the sheet delivery rollers 40 and 41 (FIG. 5). The sheet delivery rollers 40 and 41 are attached to the platen 34. The sheet delivery roller 40, which is on the upstream side in the transporting direction, is a metal axis having a plurality of rubber portions (sheet delivery roller rubber) 401. The sheet delivery roller 40 is driven by the driving force transmitted from the transport roller 36 through an idler gear. The sheet delivery roller 41 is a resin axis to which elastomer or similar elastic bodies 411 are attached. The sheet delivery roller 41 is driven by the driving force transmitted from the sheet delivery roller 40 through an idler gear.

The spurs 42 are each obtained by, for example, molding as one a resin portion and an SUS thin plate that has convex shapes along its perimeter. The spurs 42 thus constructed are attached to a spur holder 43. In this embodiment, a spur spring 44 which is a coil spring shaped like a rod is used to attach the spurs 42 to the spur holder 43 and to press the spurs 42 against the sheet delivery rollers 40 and 41. Some of the spurs 42 mainly generate a force to transport the sheet material P and others mainly prevent the sheet material P from floating during recording. The spurs for generating the force to transport are placed in positions that face the rubber portions (sheet delivery roller rubber portions and elastic body portions) of the sheet delivery rollers 40 and 41. On the other hand, the spurs that prevent the sheet material P from floating are placed in positions where the rubber portions 401 of the sheet delivery rollers 40 and 41 are not located (for example, between the rubber portions 401).

A paper end support 45 is provided between the sheet delivery rollers 40 and 41. The paper end support 45 lifts both ends of the sheet material P and holds the sheet material P ahead of the sheet delivery rollers 40 and 41 to thereby prevent the image recording portion on the sheet material P from being scuffed, which would damage the recorded image or lower the quality thereof. The paper end support 45 is composed of a resin member, which has a skid 451 on its front end, and a paper end support spring 452. The resin member is biased by the paper end support spring 452 to press the skid 451 against the sheet material P under a given pressure. In this way, both ends of the sheet material P are lifted giving the sheet material P a 'hip' and the paper end support 45 holds the sheet material P by its hip.

With the above structure, the sheet material P on which an image has been recorded (formed) in the carriage unit 5 is nipped and transported by the nip portion between the sheet delivery roller 41 and the spurs 42, and delivered onto a sheet delivery tray 46. The sheet delivery tray 46 has a breakaway structure and, when broken into plural parts, can be housed in the bottom of a lower case 99 of the recording apparatus. The sheet delivery tray 46 is pulled out when in use. In the sheet delivery tray 46 shown in the drawing, the height is increased toward its tip and both edges stand higher than the middle as well. In this way, the sheet material P delivered is stacked neatly and the recording face of the sheet material P is prevented from being scuffed (FIG. 2).

(E) Recovery Mechanism (Cleaning Unit)

The recovery mechanism (cleaning unit) 6 has a pump (suction pump or the like to serve as a negative pressure source) 60, a cap 61, and wiping means (blades) 62. The pump 60 is used in a suction recovery process (cleaning operation) for recovering and maintaining the jetting ability of the recording head 7. The cap 61 protects the discharge port face of the recording head 7 and prevents the face from drying. The wiping means 62 wipes away ink, dust, or other incrustation around the discharge port on the discharge port face of the recording head 7. The recovery mechanism 6 has a dedicated recovery motor 69. A one-way clutch 691 is included in the recovery mechanism 6, so that the recovery motor 69 is rotated in one direction to operate the pump 60 whereas the motor is rotated in the other direction (reverse rotation) to activate the wiping operation of the blades 62 and the lifting and lowering operation of the cap 61.

In this embodiment, the pump 60 is structured to generate a negative pressure by pushing two tubes 67 through pump skids 68. A valve 65 and other components are provided in a suction path (a tube or the like) leading from the cap 61 to the pump 60. The suction recovery means suctions and discharges thickened ink, bubbles, and dust or other foreign objects from the discharge port of the recording head 7 along with normal ink by a negative pressure, which is generated in the cap 61 by operating the pump 60 with the cap 61 tightly pulled over the discharge port face of the recording head 7 (capped state). A cap absorber 611 for reducing the amount of residual ink (crusted ink) on the discharge port face of the recording head 7 after the suction is provided in the cap 61. In order to prevent residual ink from adhering to the cap absorber 611, the mechanism is structured such that residual ink is suctioned and removed from the interior of the cap 61 through an idle suction action in which the suction pump 60 is operated with the cap 61 open. The waste ink suctioned out by the pump 60 is absorbed and held in a waste ink absorber 991 placed in the lower case 99, which is described later.

Various recovery process operations in the recovery mechanism 6, namely, a series of recovery operations including the wiping operation by the blades 62, the closing-in and distancing operation (lifting and lowering operation) of the cap 61, and the opening and closing operation of the valve 65 located between the cap 61 and the pump 60, are controlled by a main cam 63, which is composed of plural coaxial cams. Each given recovery process operation is achieved by operating relevant cams, arms (levers), and the like corresponding to each of the recovery process operations with the main cam 63. The position of the main cam 63 (rotation position and the like) is detected by a position detection sensor 64 which is, for example, a photo interrupter. When the cap 61 is apart from the recording head (when the cap 61 is lowered in this embodiment), the blades 62 are moved in a direction that is at right angles with the main scanning direction of the carriage 50 to wipe (clean) the discharge port face of the recording head 7. In this embodiment, the blades 62 are composed of a blade for wiping the vicinity of the discharge port face of the recording head 7 and a blade for sweeping the entire discharge port face. When moved to the farthest point in the back, the blades 62 are pressed against a blade cleaner 66 and ink or the like adhering to the blades 62 is removed to recover the wiping ability of the blades 62.

(F) Exterior Package

The functional units and mechanisms described above are incorporated in the chassis 11 of the recording apparatus to constitute the machinery of the recording apparatus. The machinery is entirely covered with an external package. The external package is mainly composed of the lower case 99, an upper case 98, an access cover 97, a connector cover 96, and a front cover 95. A sheet delivery tray rail 992 is laid on the bottom of the lower case 99, so that the sheet delivery tray 46 is housed in the lower case 99 after broken into parts. The front cover 95 blocks the sheet delivery port when it is not in use.

The access cover 97 is rotatably attached to the upper case 98. An opening is formed in a part of the top face of the upper case 98. The opening is for replacing an ink tank 71, the recording head 7, and other exchangeable components. The upper case 98 has a door switch lever 981 for detecting opening and closing of the access cover 97, an LED guide 982 for transmitting light from an LED to an indicator, a key switch 983 for SW of the electricity unit (circuit substrate) 6, and the like. The upper case 98 also has the multistage sheet feeding tray 26 attached thereto in a rotatable manner. The sheet feeding tray 26 can be put away to function as a cover of the sheet feeding unit when the sheet feeding unit is not in use. The upper case 98 and the lower case 99 are attached to each other by an elastic engaging claw. The area where the connector between the upper case 98 and the lower case 99 is located is covered with the connector cover 96.

Figure 8:
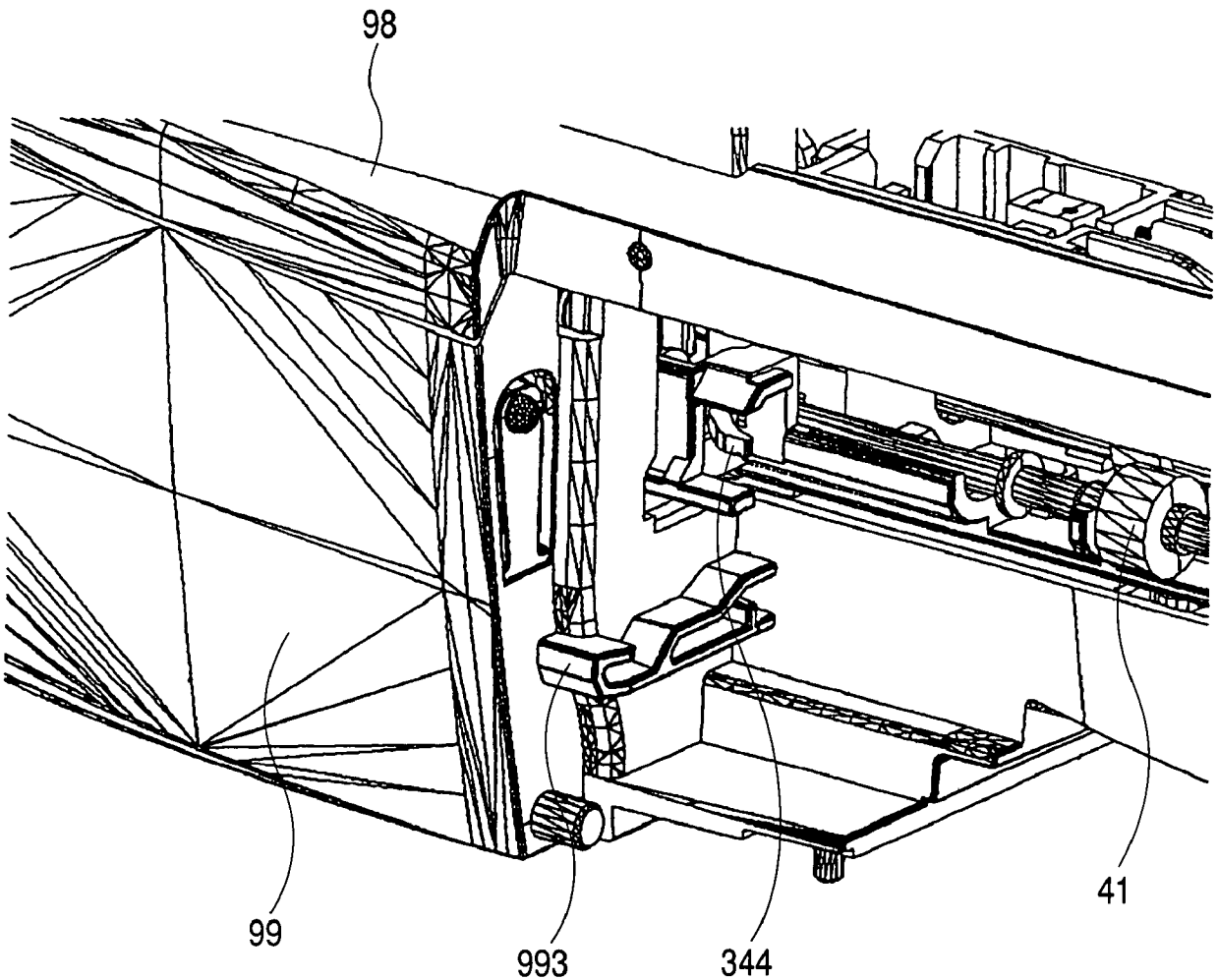
FIG. 8 is a partial perspective view showing a portion of a lower case to which a CD transporting unit is attached and an attachment detecting unit in an embodiment of a recording apparatus to which the present invention is applied.
Figure 9:
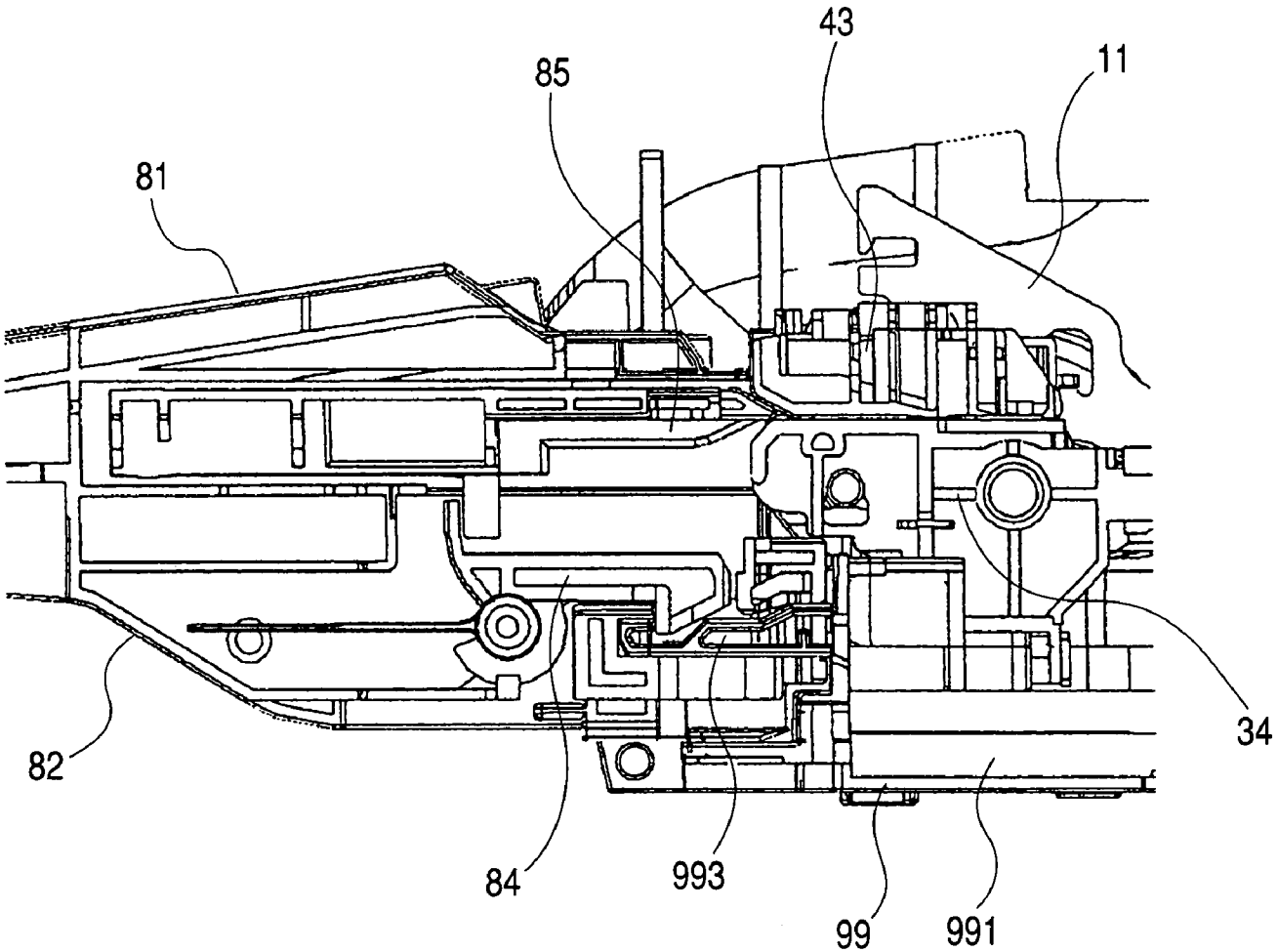
FIG. 9 is a partial vertical sectional view showing how a hook of a CD transporting unit is attached to a lower case in an embodiment of a recording apparatus to which the present invention is applied.
Figure 10A:
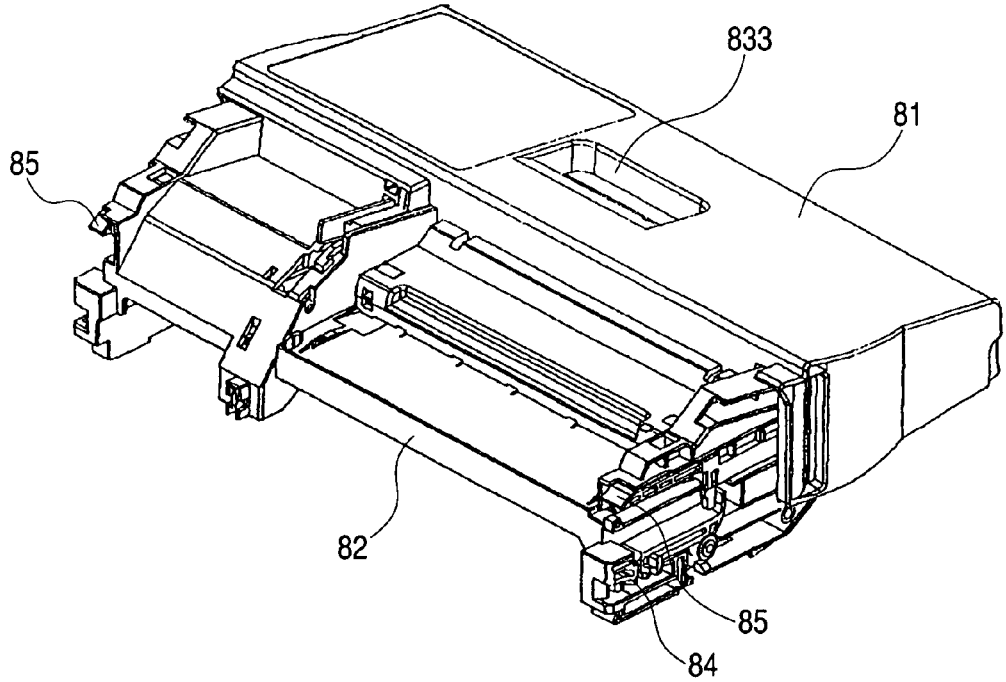
FIGS. 10A and 10B are perspective views of a recording apparatus to which the present invention is applied when a slide cover is moved before and after a CD transporting unit attachable to the recording apparatus is attached.
Figure 10B:
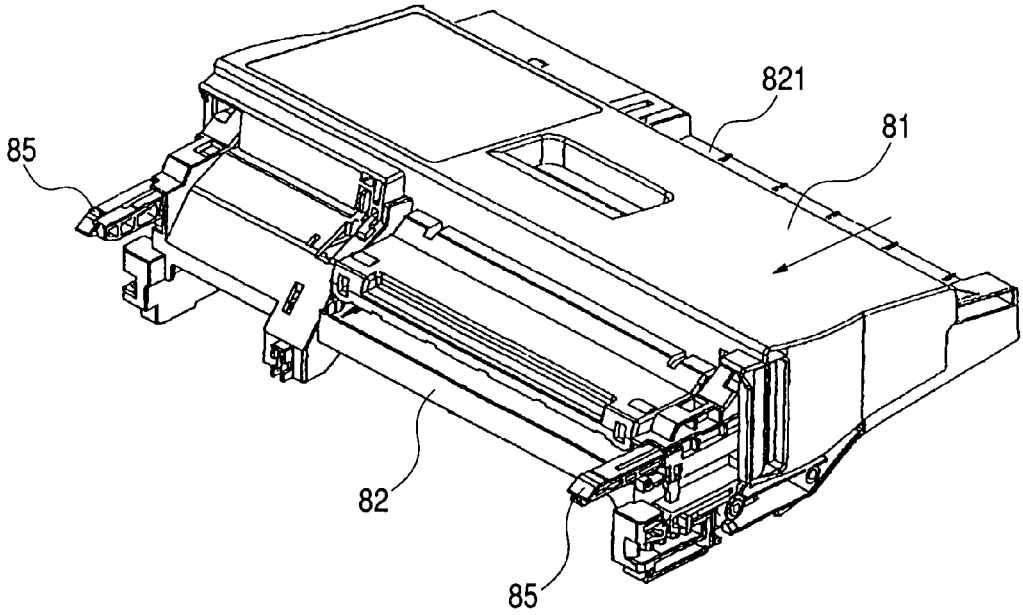
Figure 11:
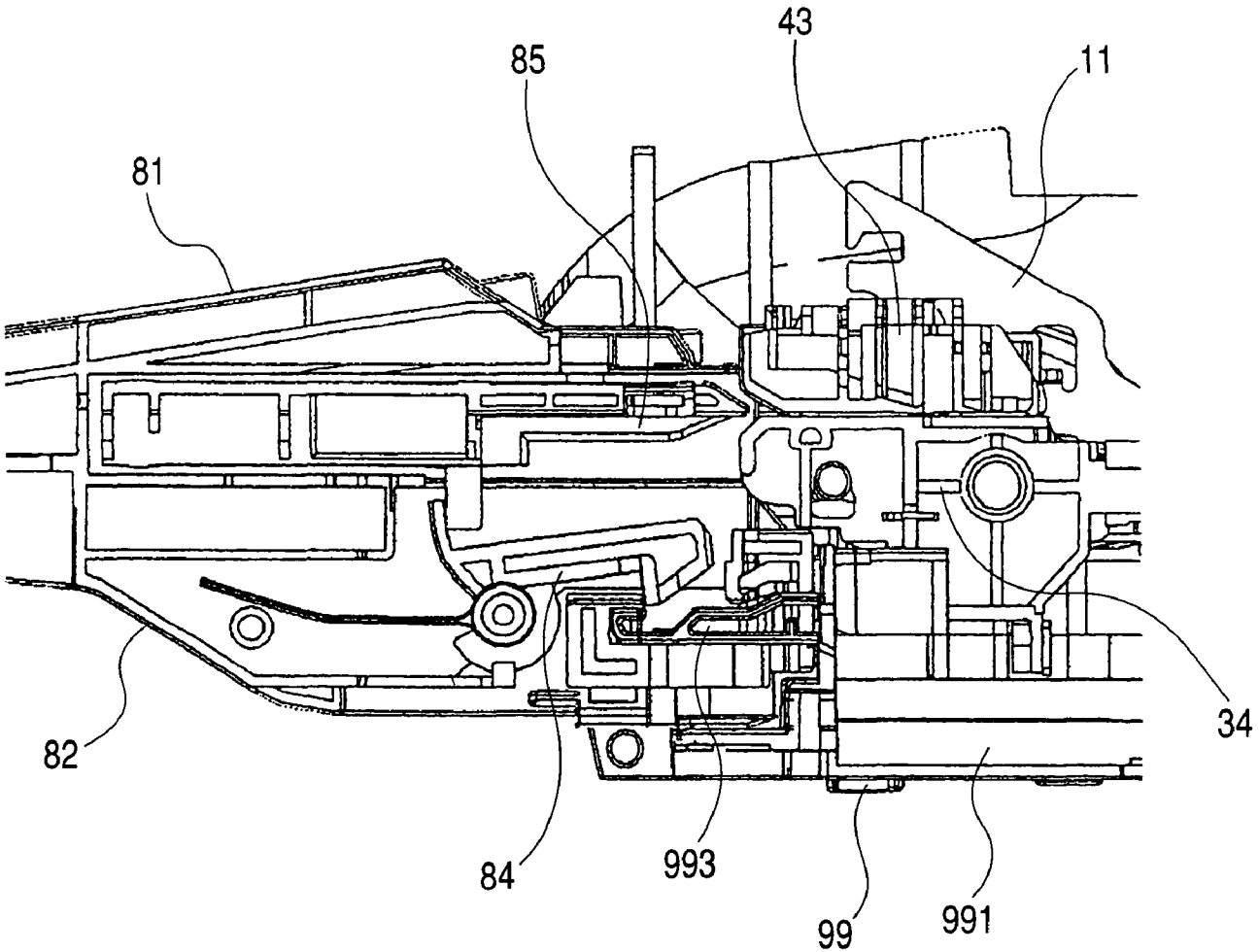
FIG. 11 is a partial vertical sectional view showing a lower case from which a hook of a CD transporting unit is detached in an embodiment of a recording apparatus to which the present invention is applied.
Figure 12A:
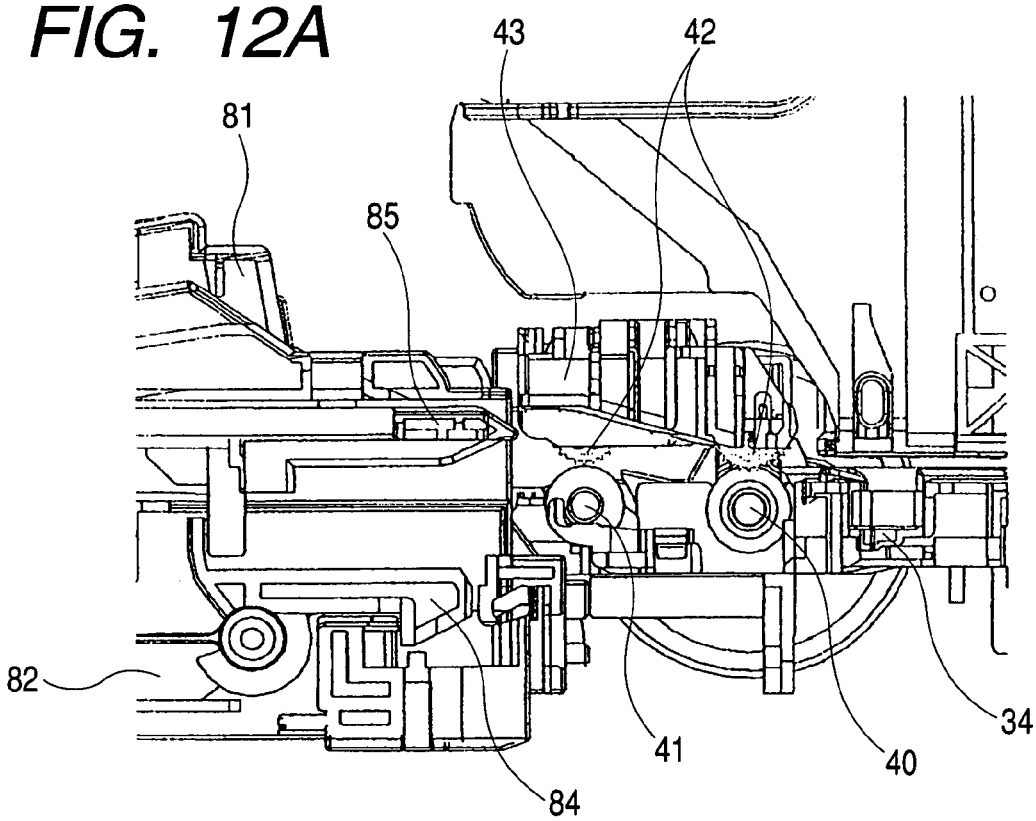
FIGS. 12A and 12B are partial vertical sectional views showing the state of an arm of a CD transporting unit before and after a slide cover is moved in an embodiment of a recording apparatus to which the present invention is applied.
Figure 12B:
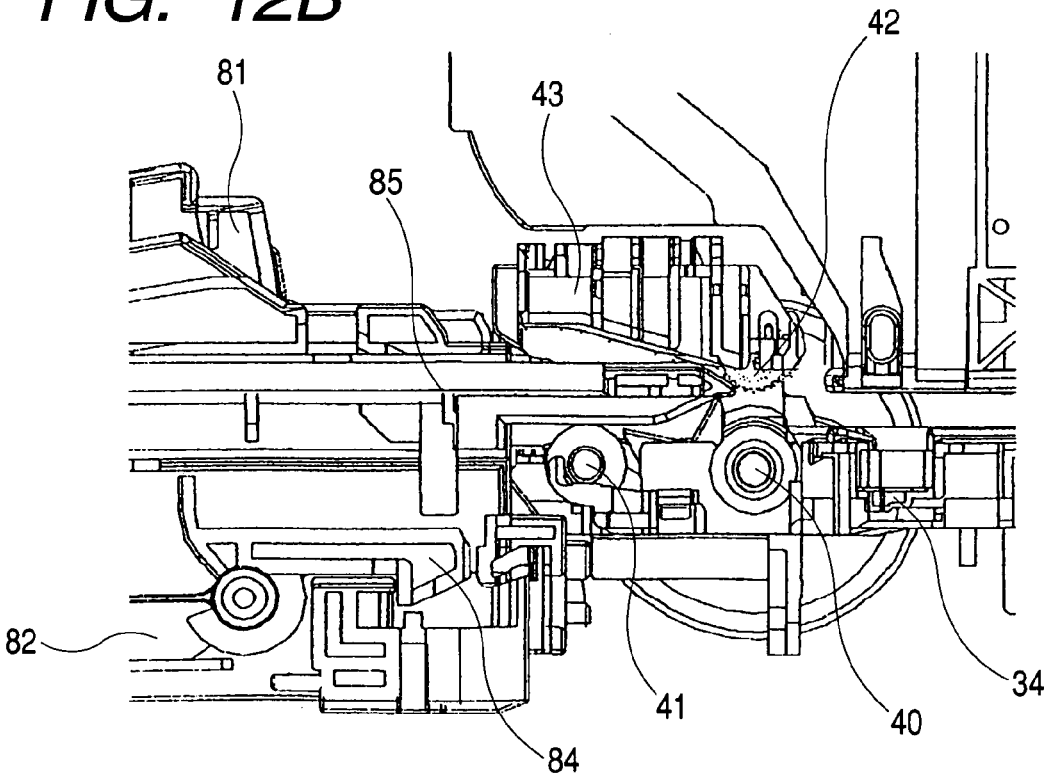

Described next with reference to FIGS. 6A to 19 are a structure of when the CD (compact disc) transporting unit 8 is employed and details of printing on a CD in the recording apparatus to which the present invention is applied. FIGS. 6A and 6B are perspective views showing the recording apparatus of FIG. 1 before and after the CD transporting unit 8 is attached, respectively. FIG. 7 is a perspective view showing the CD transporting unit 8 attachable to the recording apparatus of FIG. 1. FIG. 8 is a partial perspective view showing a portion of the lower case 99 where the CD transporting unit 8 is attached and an attachment detecting unit. FIG. 9 is a partial vertical sectional view showing how a hook 84 of the CD transporting unit 8 is attached to the lower case 99. FIGS. 10A and 10B are perspective views showing a slide cover 81 being moved before and after the CD transporting unit 8 is attached, respectively. FIG. 11 is a partial vertical sectional view showing the lower case 99 from which the hook 84 of the CD transporting unit 8 is detached. FIGS. 12A and 12B are partial vertical sectional views showing the state of an arm 85 of the CD transporting unit 8 before and after the slide cover 81 is moved, respectively.

Figure 13:
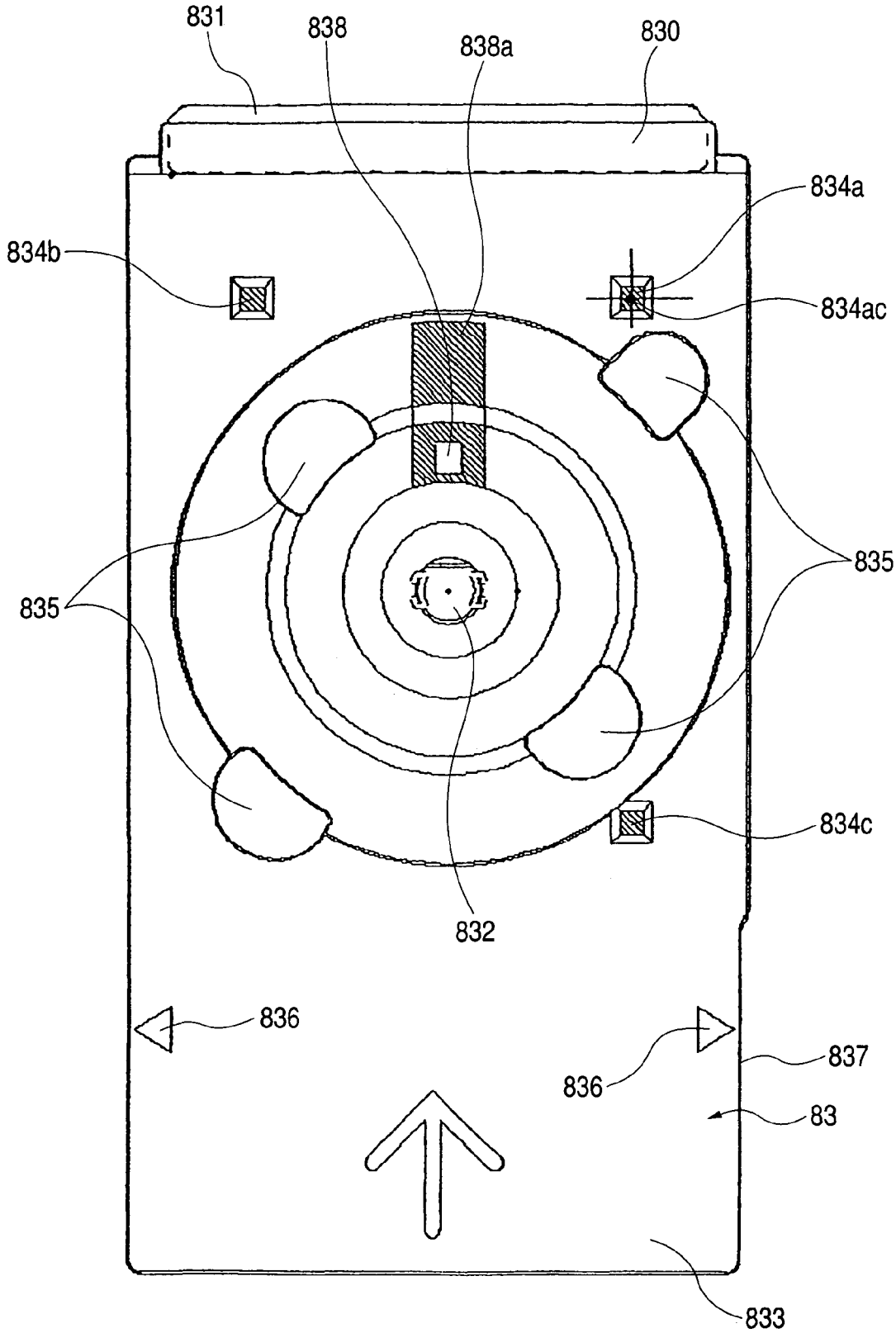
FIG. 13 is a plan view of a tray of a CD transporting unit in an embodiment of a recording apparatus to which the present invention is applied.
Figure 14:
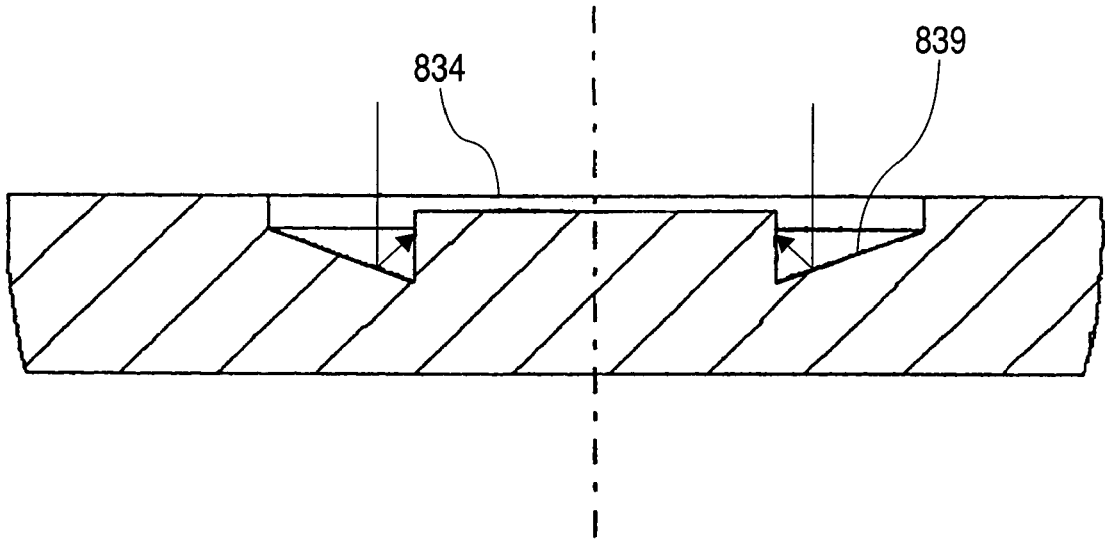
FIG. 14 is a schematic sectional view showing the shape of a concave portion of a position detecting unit in the tray of FIG. 13.
Figure 15A:
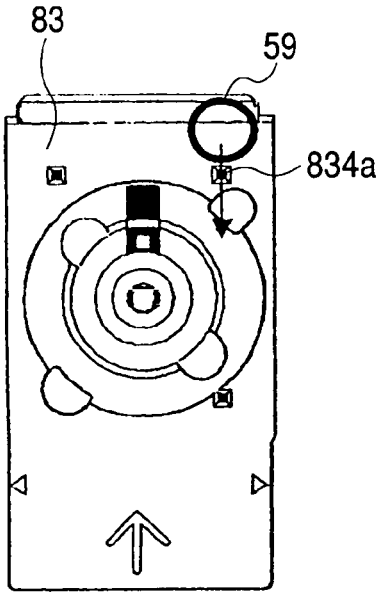
FIGS. 15A, 15B, 15C, 15D, 15E, and 15F are schematic plan views showing positions of the tray of FIG. 13 in relation to a tray position detection sensor.
Figure 15B:
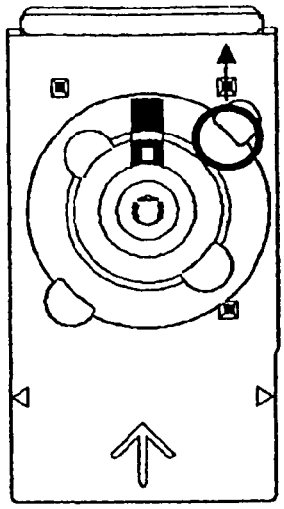
Figure 16:
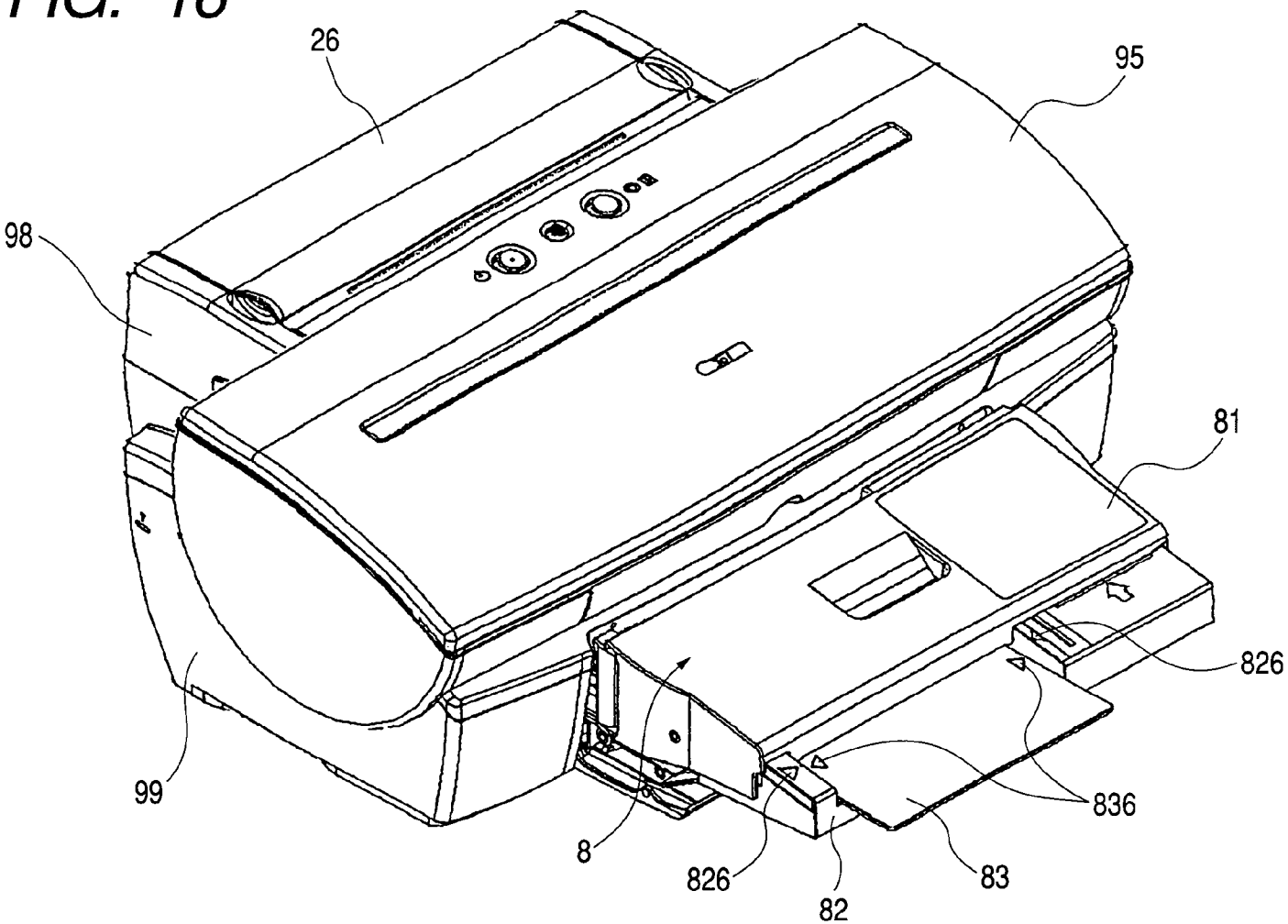
FIG. 16 is a perspective view showing a tray inserted and set in a CD transporting unit that is attached to a recording apparatus in accordance with an embodiment to which the present invention is applied.
Figure 17:
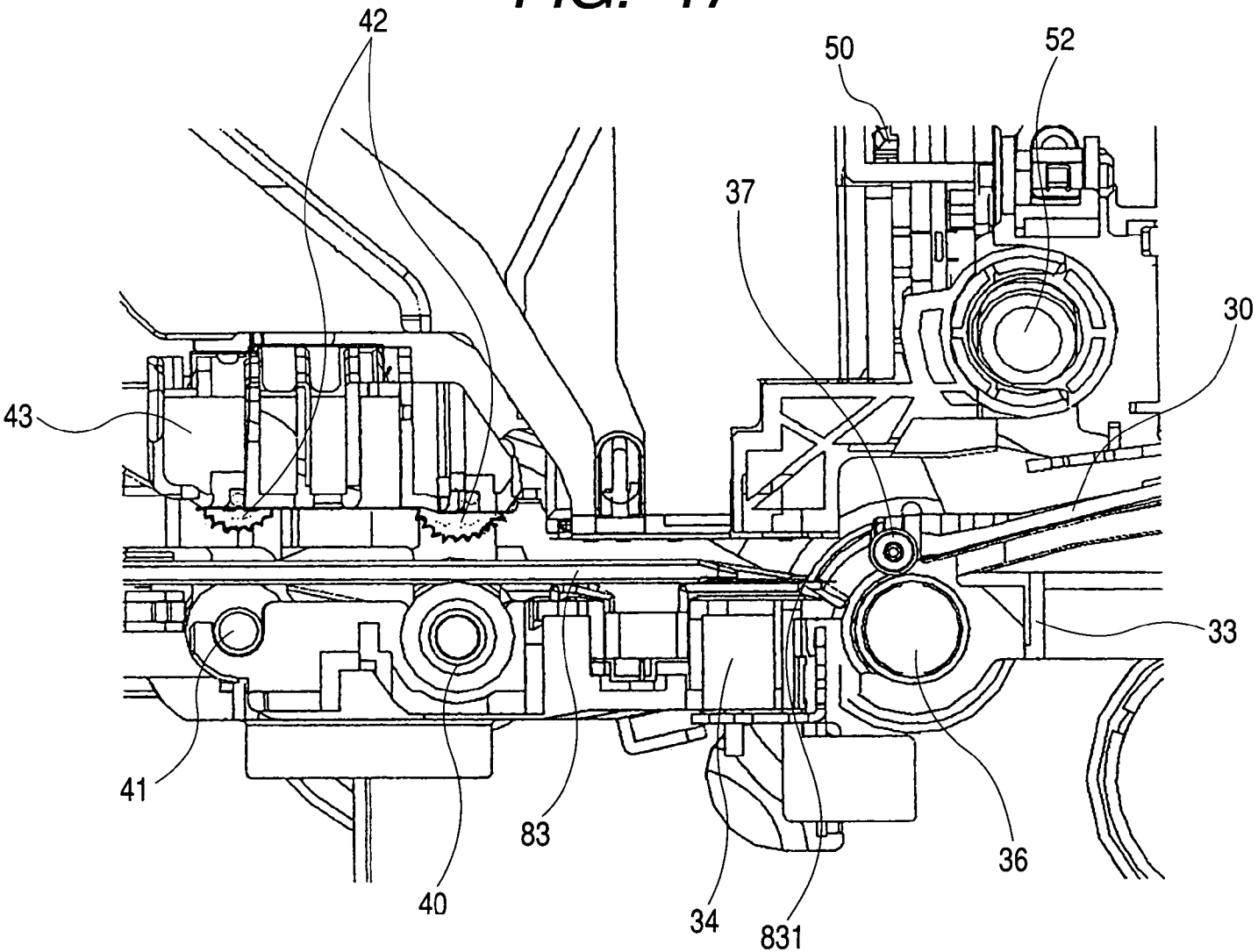
FIG. 17 is a partial vertical sectional view showing how a tray is transported in a recording apparatus in accordance with an embodiment to which the present invention is applied.
Figure 18A:
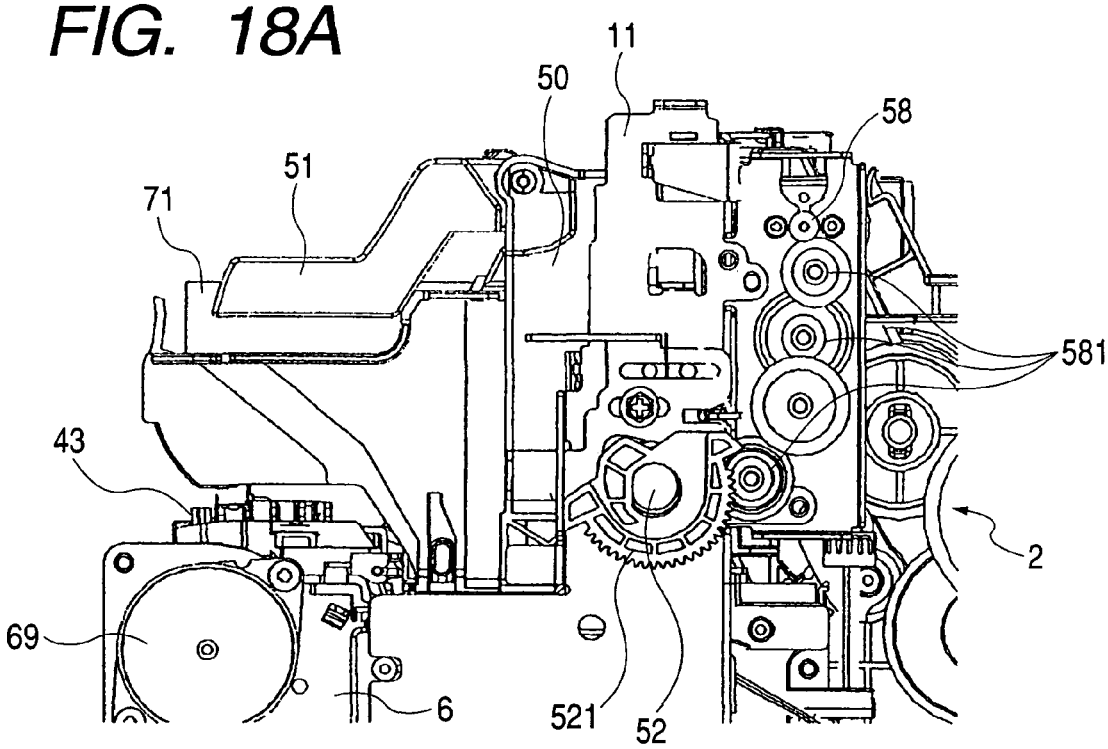
FIGS. 18A and 18B are partial vertical sectional views of an area near a shaft lifting mechanism for lifting and lowering a guide shaft of a carriage in an embodiment of a recording apparatus to which the present invention is applied, FIG. 18A showing the shaft lifting mechanism lowering the carriage, FIG. 18B showing the shaft lifting mechanism lifting the carriage.
Figure 18B:
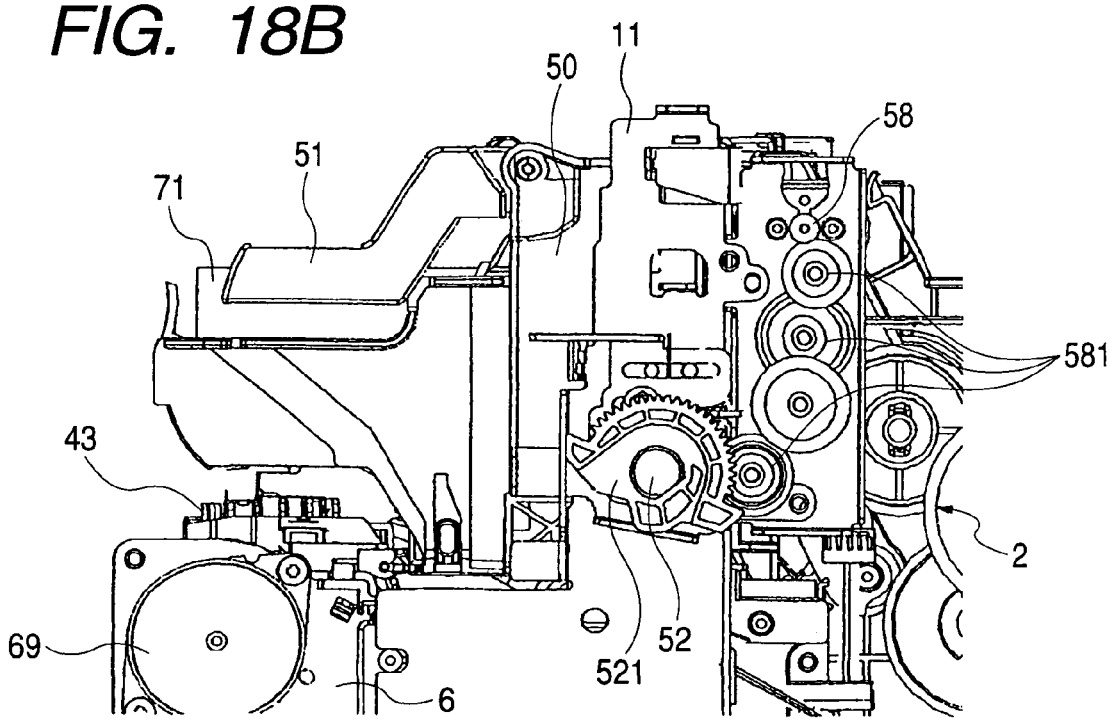
Figure 19:
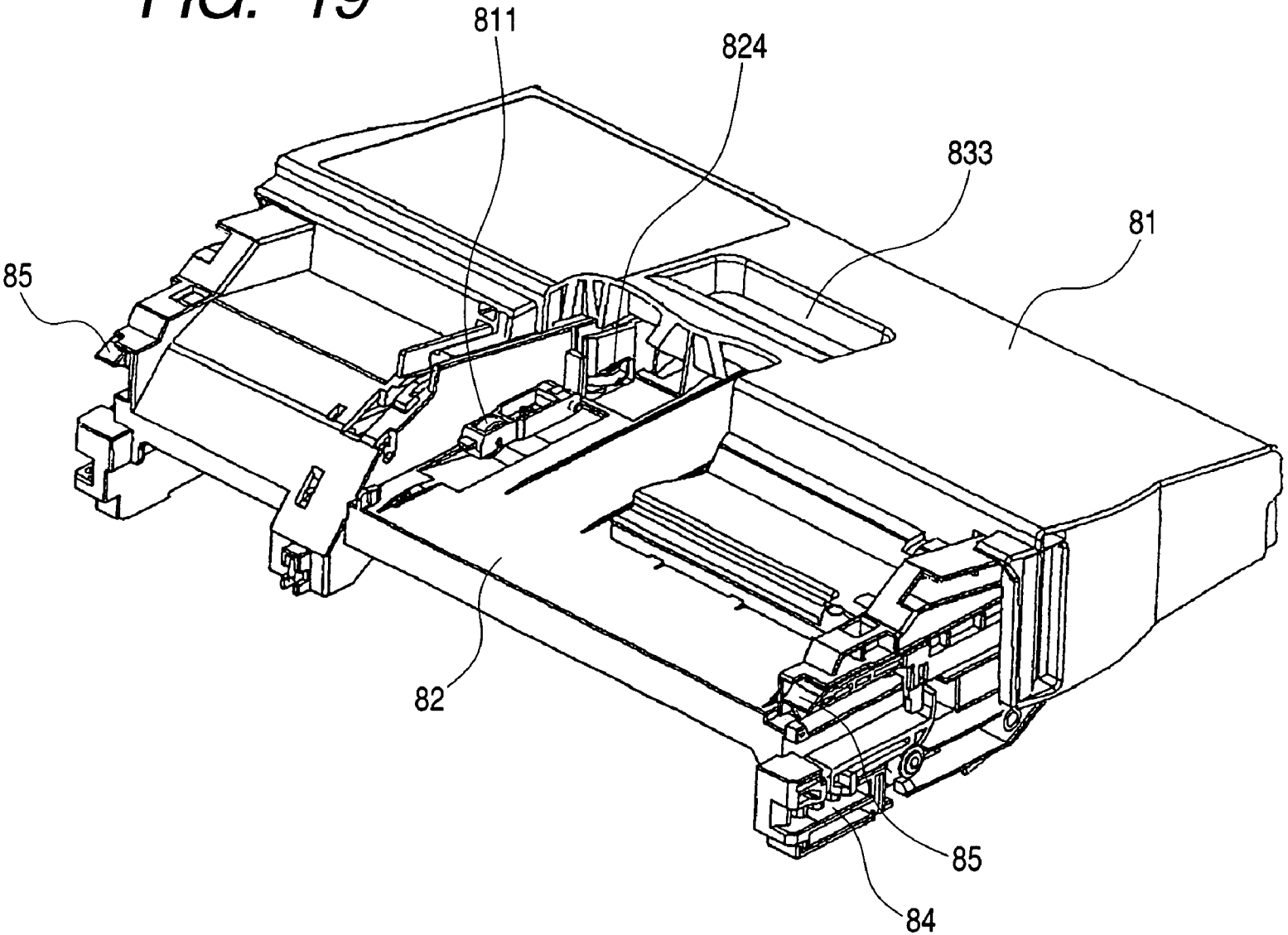
FIG. 19 is a perspective view obtained by cutting a portion of a CD transporting unit off to show a depression skid and a lateral pressure skid of the CD transporting unit, which is attached to a recording apparatus in accordance with an embodiment to which the present invention is applied.

FIG. 13 is a plan view of the tray 83 of the CD transporting unit 8. FIG. 14 is a schematic sectional view showing the shape of a concave portion of a position detecting unit in the tray 83 of FIG. 13. FIGS. 15A to 15F are schematic plan views showing positions of the tray of FIG. 13 in relation to the tray position detection sensor 59. FIG. 16 is a perspective view showing the tray 83 inserted and set in the CD transporting unit 8 that is attached to the recording apparatus. FIG. 17 is a partial vertical sectional view showing how the tray 83 is transported through the interior of the recording apparatus. FIGS. 18A and 18B are partial vertical sectional views of a shaft lifting mechanism for lifting and lowering the guide shaft 52 of the carriage 50, FIG. 18A showing the shaft lifting mechanism lowering the carriage 50, FIG. 18B showing the shaft lifting mechanism lifting the carriage 50. FIG. 19 is a perspective view obtained by cutting a portion of the CD transporting unit 8 off to show a depression skid 811 and a lateral pressure skid 824 of the CD transporting unit 8.

FIG. 6A shows the recording apparatus before the CD transporting unit 8 is attached thereto and FIG. 6B shows the recording apparatus after the CD transporting unit 8 is attached thereto. As shown in FIGS. 6A and 6B, the CD transporting unit 8 is fit in the lower case 99 of the recording apparatus by sliding the CD transporting unit 8 straight in the direction an arrow Y indicated in the drawings. At this point, the CD transporting unit 8 is positioned by inserting an engagement portion 822 on each edge of the tray guide 82 along a guide rail 933 that is provided on each side of the lower case 99 shown in FIGS. 8 and 9. The rotatable hook 84 is provided on the left and right side edge of the tray guide 82 each. The hook 84 is biased in one direction. The CD transporting unit 8 is slid and inserted until it bumps against a certain component, so that it is no longer inserted past a given point. Then the hook 84 works on a stopper of the guide rail 993 to lock the CD transporting unit 8 at the given point and prevent the CD transporting unit 8 from sliding back the way the unit has been slid. That the tray guide 82 (CD transporting unit 8) is set at the given point in the recording apparatus is mechanically detected by a tray guide detection sensor 344, which is placed on the platen 34. When the tray guide 82 is attached to the main body of the recording apparatus, a part of the tray guide 82 pushes the tray guide detection sensor 344 and thus attachment of the CD transporting unit 8 (tray guide 82) is detected.

Starting from the state shown in FIGS. 10A and 12A, the CD transporting unit 8 is attached to the recording apparatus and then the slide cover 81 is moved toward the main body of the recording apparatus while the motion of the slide cover 81 makes the arm 85 protrude in the direction of the recording apparatus main body as shown in FIGS. 10B and 12B. The spur holder 43 holding the spurs 42 is attached to the platen 34 in a manner that allows the spur holder 43 to move up and down, and is biased downward by the force of a spring at a given pressure. When the arm 85 enters between the spur holder 43 and the platen 34, the spur holder 43 is lifted to a given degree. The arm 85 enters the gap between the platen 34 and the spur holder 43 smoothly owing to a sloped portion 851 at the tip of the arm 85. In this way, a space for allowing the passage of the tray 83 mounted with such a recording medium as CD (or CD-R) is formed between the platen 34 and the spur holder 43.

The arm 85 is positioned as it is inserted between the platen 34 and the spur holder 43. Before protruding (moving forward), the arm 85 is housed in the tray guide 82 with a space to rattle around. The tray 83 cannot be inserted until the slide cover 81 is moved in the direction of the recording apparatus main body because otherwise an opening 821 of the CD transporting unit 8 is closed. As the slide cover 81 is moved in the direction of the recording apparatus main body, the slide cover 81 moves upward at an angle. This forms the opening 821 for insertion of the tray between the slide cover 81 and the tray guide 82. With the slide cover 81 moved out, the tray 83 loaded with a CD can be inserted into the opening 821 and set at a given position as shown in FIG. 16. This structure is chosen to prevent interference between the tray 83 and the spurs 42 which takes place when the tray 83 is inserted without lifting the spur holder 43 and which could damage a tray sheet 831 at the front end of the tray 83 as well as the spurs 42.

When the slide cover 81 is pulled out of the main body with the tray guide 82 attached as shown in FIG. 11, the arm 85 is detached from the spur holder 43 in conjunction with the motion of the slide cover 81 to lower the spur holder 43 and the spurs 42 to their original positions. If the tray 83 remains attached at this point, the tray 83 is stuck in the opening 821 between the slide cover 81 and the tray guide 82 making it impossible to pull out the slide cover 81 any further. This is to avoid an inconvenience of damaging a recording medium such as a CD or a CD-R left in the main body of the recording apparatus with the lowered spurs 42. When the slide cover 81 is pulled further, as shown in FIG. 11, the slide cover 81 works on the hook 84 to unhook the hook 84 from the guide rail 993 of the lower case 99 and detach the CD transporting unit 8 from the main body of the recording apparatus.

The tray 83 according to this embodiment is a resin plate with a thickness of 2 to 3 mm. As shown in FIG. 13, the resin plate has a CD attachment portion 832; a handle portion 833 which is grabbed by an operator in pulling the tray in and out; the position detection marks 834 (in FIG. 13, 834*a*, 834*b*, and 834*c*, three marks in total); CD take out holes 835; insertion positioning marks 836; a lateral pressure skid clearance 837; a media presence detection mark 838; and a tray adaptor type detection mark 838*a* provided for discriminating the type of a tray adaptor. The tray sheet 831 attached to the front end of the tray 83 is for ensuring that the tray 83 is gripped between the transport roller 36 and the pinch rollers 37.

Of the position detection marks 834, two (834*a* and 834*b*) are in the front half of the CD attachment portion of the tray 83 and one (834*c*) is on the opposite side of the two. Each of the position detection marks 834 is formed of a highly reflective material and shaped into a 3 to 10 mm square. Here, the position detection marks 834 are formed by hot stamp. The position detection marks 834 are each surrounded by a concave portion 839 as shown in FIGS. 13 and 14 so that the reflective material is formed into the shape of the resin component position detection marks 834. As shown in FIG. 14, the bottom of the concave portion 839 has excellent surface properties and is inclined at a given angle. Accordingly, if light emitted from the tray position detection sensor 59 mounted on the carriage 50 is reflected not by the position detection marks 834 but by their surrounding areas, the reflected light is prevented from reaching the light receiving portion. An error in detecting the position of the tray 83 is thus avoided.

Since the position detection marks 834 on the tray 83 have high reflectivity as described above, the sensor mounted does not need to be of high performance and correction or similar process is reduced in number. In this way, an increase in cost or recording time (printing time) is avoided. Compared to the method in which the edge of the print region (recording region) of a CD is directly read, the position of a CD can be detected more accurately even when printing on a colored CD, or when reprinting on an already printed CD. The CD attachment portion 832 has a plurality of mold claws for positioning and fixing a CD in the tray without allowing the CD to rattle around. An operator fits a CD to the tray by positioning the center hole in a CD to the CD attachment portion 832. To remove the CD, an operator picks up the CD by its edge (circumference) utilizing the two CD take out holes 835. The CD attachment portion 832 is one step lower than the rest of the tray 83 and the media presence detection mark 838 for detecting the presence or absence of a CD is located on the lowered level. The media presence detection mark 838 for detecting the presence or absence of a CD is obtained by opening a hole of a given width in a hot stamp of a given width, and the absence of a media is recognized when this hole width is detected.

As shown in FIG. 13, the tray sheet 831 is attached to the front end of the tray 83, so that the tray 83 is securely nipped between the transport roller 36 and the pinch rollers 37. The tray sheet 831 is a sheet material which is formed of PET or the like and which is 0.1 to 0.3 mm in thickness. The tray sheet 831 has a given friction coefficient and a given degree of hardness. The tray 83 itself is tapered at the front end thereof (tapered portion 830). The tray sheet 831 is first gripped between the transport roller 36 and the pinch rollers 37 to generate a transportation force, and then the tapered portion 830, which is the front end of the tray 83, lifts the pinch rollers 37 to enable the transport roller 36 and the pinch rollers 37 to nip the thick tray 83 between them. The tray 83 is thus transported accurately. The position detection marks 834 are placed between the pinch rollers 37. Accordingly, the position detection marks 834 do not come into contact with the pinch rollers 37 and there is no fear of damaging the surfaces of the position detection marks 834.

In FIG. 19, the tray guide 82 constituting the CD transporting unit 8 is provided with the lateral pressure skid 824 for pushing the tray 83 shown in FIG. 13 against a reference 823 of the tray guide 82. Using a skid spring 825, the lateral pressure skid 824 pushes the tray 83 against the reference 823 at a given pressure for positioning. The lateral pressure skid 824 exerts its effect until an operator sets the tray 83 at a given position. The lateral pressure skid 824 no longer works on the tray 83 once the tray 83 is transported by the transport roller 36 and the pinch rollers 37 to move the lateral pressure clearance 387 (FIG. 13) into the point where the effect of the lateral pressure skid 824 is received. This structure is employed to avoid unnecessary back tension on the tray 83 and thus prevent the accuracy in transporting the tray 83 from lowering.

As shown in FIG. 19, the depression skid 811 is provided on the left and right side of the slide cover 81 each. Using a skid spring 812, the depression skid 811 pushes the tray 83 against the sheet delivery roller 41 to generate a force to transport the tray 83. The transportation force sends the tray 83, which is at a set position at the start of recording (printing), to the nip portion between the transport roller 36 and the pinch rollers 37. As the recording (printing) is finished, the same transportation force sends the tray 83 to a given point where the tray 83 is taken out by an operator. In this case as well, the position detection marks 834 and the depression skid 811 are located in different places in order to prevent the position detection marks 834 from coming into contact with the depression skid 811 and scarring their surfaces. Once transported to the given point, the tray 83 is pulled out of the tray guide 82. Then an operator picks up the CD by its edge (circumference) from the tray 83 utilizing the two CD take out holes 835.

A description given next is about the operation of the recording apparatus structured as above in recording (printing) on a CD. First, the CD transporting unit 8 is slid straight toward the main body of the recording apparatus 1 until the unit is attached to the lower case 99. At this point, the tray guide detection sensor 344 (FIG. 8) detects the tray guide 82 being attached to the main body of the recording apparatus. Then the slide cover 81 is moved toward the main body of the recording apparatus and the arm 85 protrudes in the direction of the main body of the recording apparatus in conjunction with the motion of the slide cover 81 as shown in FIGS. 10A and 10B. The arm 85 enters the gap between the spur holder 43 and the platen 34 to lift the spur holder 43 to a given degree.

Moved in the direction of the main body of the recording apparatus, the slide cover 81 slides upward at an angle and the opening 821 (FIGS. 6A and 6B) is formed between the slide cover 81 and the tray guide 82. In this state, the tray 83 loaded with a CD is inserted into the opening 821 and set at a given position as shown in FIG. 16. The CD is fit to the CD attachment portion 832 (FIG. 13) of the tray 83. An operator grabs the handle portion 833 (FIG. 13) to insert the tray 83 until the insertion positioning marks 836 (FIGS. 13 and 16) match tray set marks 826 (FIG. 16) of the tray guide 82.

When a recording signal (printing signal or video signal) is sent from a host in this state, the recording operation (printing operation) is started. First, the transport roller 36, the sheet delivery roller 40, and the sheet delivery roller 41 rotate backward as shown in FIG. 17. To elaborate, the depression skid 811 (FIG. 19) and the skid spring 812 push the tray 83 against the sheet delivery rollers 40 and 41 under a given pressure to generate a force to transport the tray 83 in FIG. 17 and the backward rotation of the sheet delivery rollers 40 and 41 leads the tray 83 into the interior of the recording apparatus. As the tray sheet 831 (FIG. 13) at the front end of the tray 83 is gripped between the transport roller 36 and the pinch rollers 37, a given amount of transportation force is generated and the tapered portion 830, which is the front end of the tray 83, lifts the pinch rollers 37 to enable the transport roller 36 and the pinch rollers 37 to nip the tray 83.

Next, the carriage 50 mounted with the recording head 7 moves from its home position to the recording region (printing region) in order to detect the tray 83. At this point, as shown in FIGS. 18A and 18B, the carriage lift motor 58 (FIG. 3) is put into operation and lifts the guide shaft 52 to form the optimum gap between the recording head 7 and the tray 83. As shown in FIGS. 15A and 15B, the carriage 50 stops moving when the tray position detection sensor 59 on the carriage 50 arrives at the carriage movement direction position of the position detection mark 834*a* (FIG. 13) on the tray 83. Then the tray 83 is transported and the position of the upper edge (front edge) of the position detection mark 834*a* is detected. The transportation is continued and the lower edge (rear edge) of the mark 834*a* is detected.

Figure 15C:
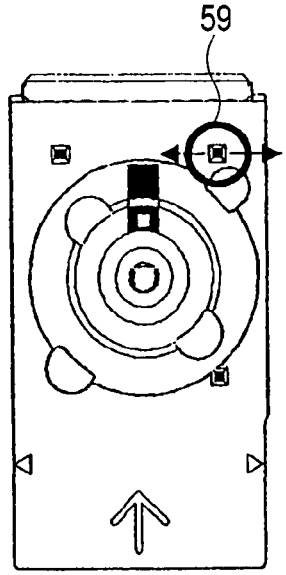

As shown in FIG. 15C, the tray 83 is then moved back until the tray position detection sensor 59 on the carriage 50 arrives at or near the center of the position detection mark 834*a* of the tray 83. The carriage 50 is moved to the left or right to detect the positions of the right and left edges of the position detection mark 834*a*. A center position 834*ac* (FIG. 13) of the position detection mark 834*a* is thus calculated and the accurate recording position (printing position) of the CD loaded in the tray 83 can be obtained from the center position 834*ac*. In this embodiment, the position of the tray 83 is detected as described above. Therefore, parts precision fluctuation and the state of the tray are less likely to cause misalignment in positioning a CD to the recording (printing) position than in the case where detection of the tray position is not included and the positioning is solely dependent of mechanical precision.

Figure 15D:
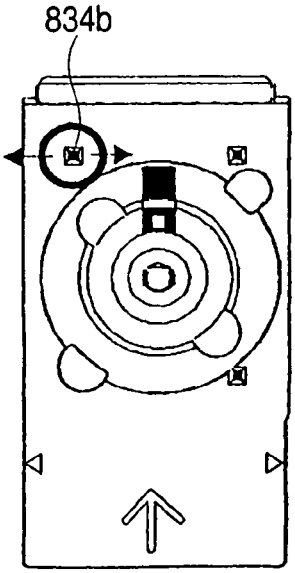
Figure 15E:
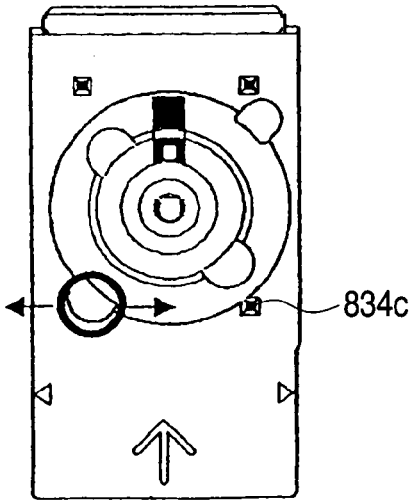

After detecting the position of the position detection mark 834*a* (the central position 834*ac*) of the tray 83, the carriage 50 is moved to detect the position detection mark 834*b* as shown in FIG. 15D. The left and right edges of the position detection mark 834*b* are detected to confirm that the previous detection of the position detection mark 834*a* is correct. This is because the moving operation to detect the position detection mark 834*b* makes it possible to prevent the position detection mark 834*c* from being mistaken as the position detection mark 834*a* when the tray 83 is accidentally inserted further than its regular set position and the position of the position detection mark 834*c* is detected as shown in FIG. 15E.

Figure 15F:
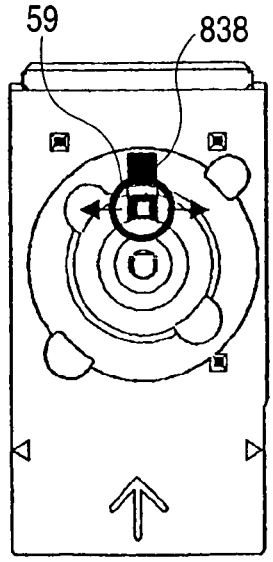

After the position of the tray 83 is detected, the tray 83 is transported in the tray 38 transporting direction until the position of the tray position detection sensor 59 of the carriage 50 coincides with the position of the media presence detection mark 838 (FIG. 13) of the tray 83 as shown in FIG. 15F. At this point, if the edge of the detection hole of the media presence detection mark 838 is detected and it matches the given hole width, it is judged that no CD is loaded and the recording operation (printing work) is interrupted. Then the tray 83 is sent to a given point to be discharged and an error message is displayed. On the other hand, if the media presence detection mark 838 is not detected, it is judged that a CD is loaded in the tray 83 and the recording operation is continued.

As the series of initial operations described above is finished, the tray 83 is transported to a given point in the back of the recording apparatus (printer or the like) where recording (printing) can be made on the entire surface of the CD. After that, recording (printing) is started using recording data (image data) which is sent from a host. A recorded image can be reduced in band unevenness, which is due to lack of accuracy in transporting the CD and in landing ink from the head 7, by employing multi-path recording in which an image is formed through several scans. After the recording (printing) is finished, the tray 83 is transported back to the position where the operator has set the tray 83 in the tray guide 82 prior to the printing. Now the operator can take out the tray 83 loaded with the CD on which an image has been printed. Then the slide cover 81 is pulled and moved away from the main body of the recording apparatus to unlock the arm 85 from the spur holder 43 and unhook the hook 84 from the lower case 99. The CD transporting unit 8 is thus detached from the main body of the recording apparatus. Recording is made on a CD or similar recording material by the structure and operation (action) of the recording apparatus described above.

Figure 20:
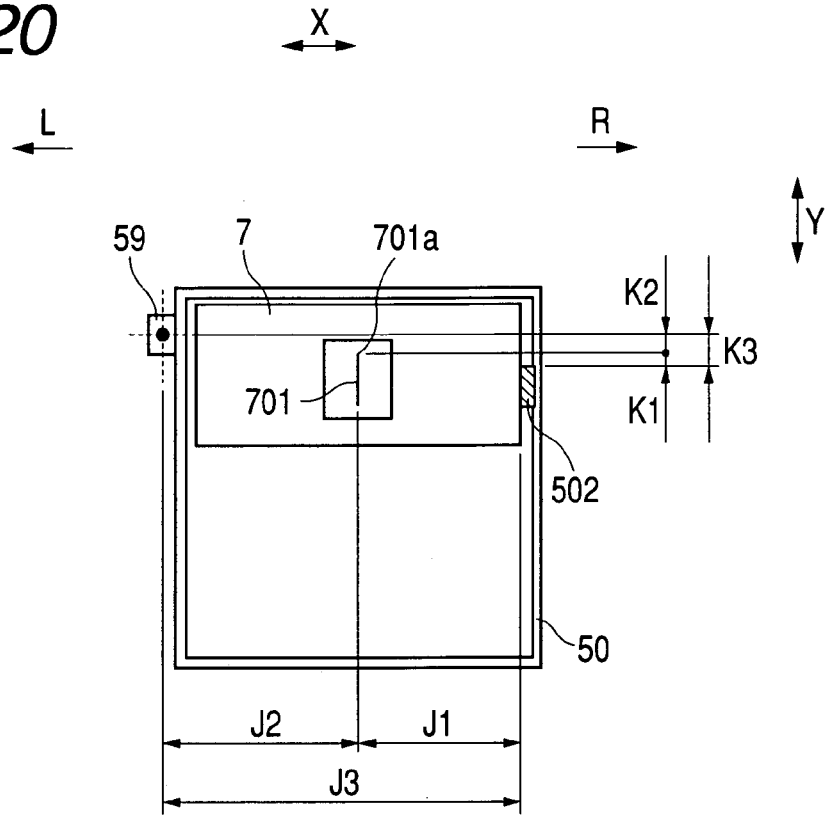
FIG. 20 is a schematic plan view showing the positional relation between a tray position detection sensor on recording means moving means and recording means in a first embodiment of a recording apparatus to which the present invention is applied.

This embodiment uses the tray position detection sensor 59 mounted on the carriage to detect the position of the tray for recording. However, since it is the recording head 7 that actually records an image, the recording position is misaligned if the position of the tray position detection sensor 59 in relation to the position of the recording head 7 is incorrect. A measure to adjust the position of the tray position detection sensor 59 in relation to the recording head 7 in an embodiment of the recording apparatus to which the present invention is applied is described with reference to FIGS. 20 to 25. FIG. 20 is a schematic plan view showing the positional relation between the tray position detection sensor 59 on the carriage 50 and the recording means (recording head) 7 in a first embodiment of the recording apparatus to which the present invention is applied. In FIG. 20, the recording head 7 mounted to the carriage 50 is biased in the direction indicated by an arrow R of FIG. 20 by a not-shown spring or the like and is thus pressed against a positioning portion 502 of the carriage.

The recording head 7 has a discharge port (discharge port array constructed by plural discharge ports) 701 through which ink is jetted for recording. A first discharge port which serves as the reference of the discharge port 701 is denoted by 701*a*. The dimensions of the first discharge port 701*a* are controlled with the portion that comes into contact with the positioning portion 502 of the carriage 50 as the reference. The measurement of the first discharge port 701*a* in a direction X is denoted by J1 and the measurement of the first discharge port 701*a* in a direction Y is denoted by K1. The dimensions of the tray position detection sensor 59 attached to the carriage 50 is controlled with the positioning portion 502, which is for positioning with respect to the recording head 7, as the reference. The measurement of the position detection sensor 59 in the direction X is denoted by J3 and the measurement of the position detection sensor 59 in the direction Y is denoted by K3.

When recording on such a recording material such as a CD in FIG. 20, the tray position detection sensor 59 detects the position of the tray 83 and recording by the recording head 7 is based on the detection result. Therefore, the distance between the tray position detection sensor 59 and the recording head 7 has to be obtained and the distance in the direction X is denoted by J2 whereas the distance in the direction Y is denoted by K2. The accuracy of the measurements J1 and K1 which express the position of the recording head 7 can readily be improved by, for example, additional processing of the reference face during manufacture of the recording head. On the other hand, a considerable increase in cost is unavoidable in raising the accuracy of the position of the tray position detection sensor 59 mounted to the carriage 50, which is a measure to move the recording means. For that reason, this embodiment is structured to measure how far the tray position detection sensor 59 mounted to the carriage 50 deviates from the predetermined position, store the measurement result (misalignment amount) in control means of the recording apparatus, and correct the misalignment before recording.

Figure 21:
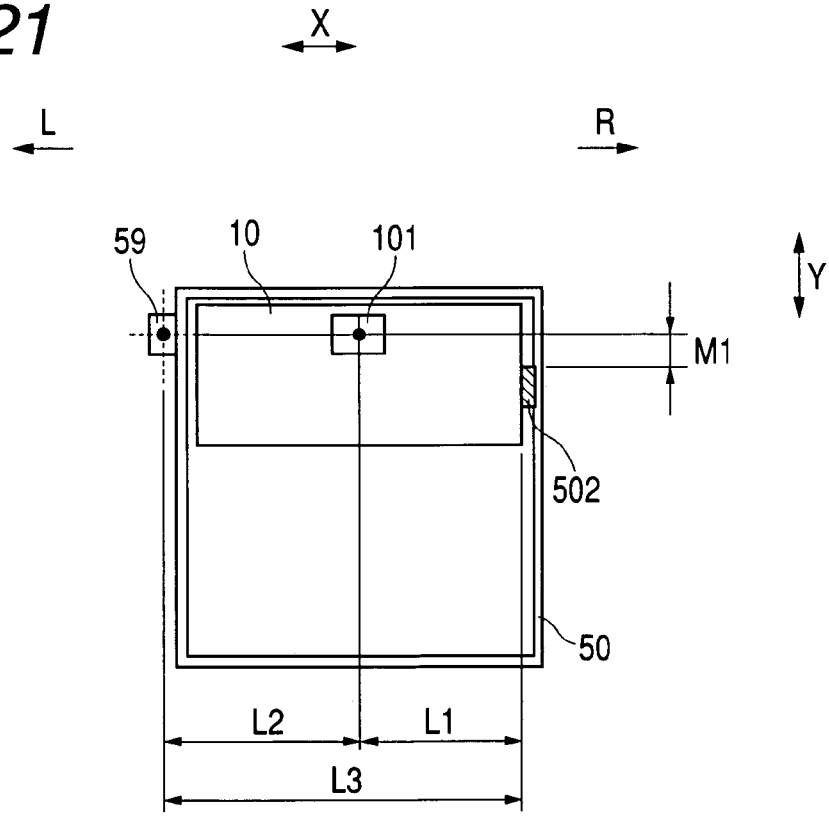
FIG. 21 is a schematic plan view showing an adjustment head which is mounted to the recording means moving means to correct the position of the tray position detection sensor in the first embodiment of the recording apparatus to which the present invention is applied.

FIG. 21 is a schematic plan view showing an adjustment head 10 which is mounted to the carriage 50 serving as the recording means moving means to correct the position of the tray position detection sensor 59 in the first embodiment of the recording apparatus to which the present invention is applied. In FIG. 21, an adjustment sensor 101 is attached to the adjustment head 10 and, similar to the recording head 7, is pressed against the bumping portion 502 of the carriage 50. The adjustment head 10 and the adjustment sensor 101 constitute adjusting means in the present invention. The position of the adjustment sensor 101 from the positioning portion (bumping portion) 502 of the carriage 50 as the recording means moving means, namely, measurements L1 and M1 in FIG. 21, is calibrated by calibration means (calibration method) that will be described later. With the adjustment sensor 101 positioned correctly, the tray position detection sensor 59 and the adjustment sensor 101 read the measurement in the direction Y by moving the position detection marks 834 or equivalent marks on the tray 83 (FIG. 13) and read the measurement in the direction X by moving the carriage 50 with respect to the position detection marks 834. When the tray position detection sensor 59 and the adjustment sensor 101 are in their right positions, it measures L2 in the direction X and zero in the direction Y which are the predetermined values. If it measures La in the direction X and Ma in the direction Y, then the sensors are deviated from the correct positions by La-L2 in the direction X and by Ma-0 in the direction Y.

Figure 22A:
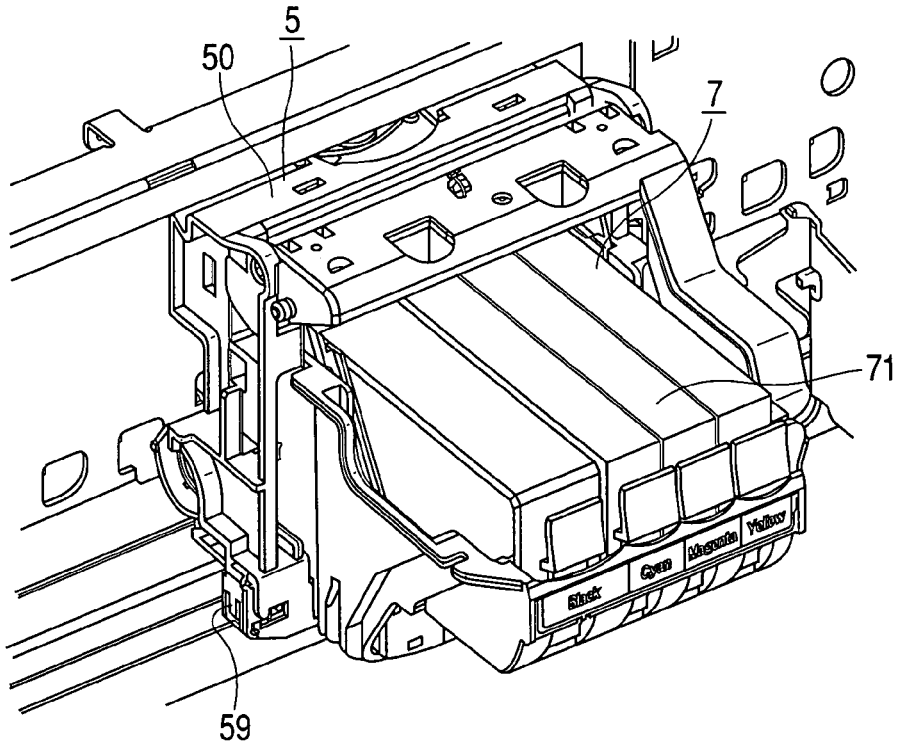
FIGS. 22A and 22B are perspective views of recording means in the first embodiment of the recording apparatus to which the present invention is applied, FIG. 22A showing the recording means mounted to the recording means moving means, FIG. 22B showing the adjustment head mounted to the recording means moving means.
Figure 22B:
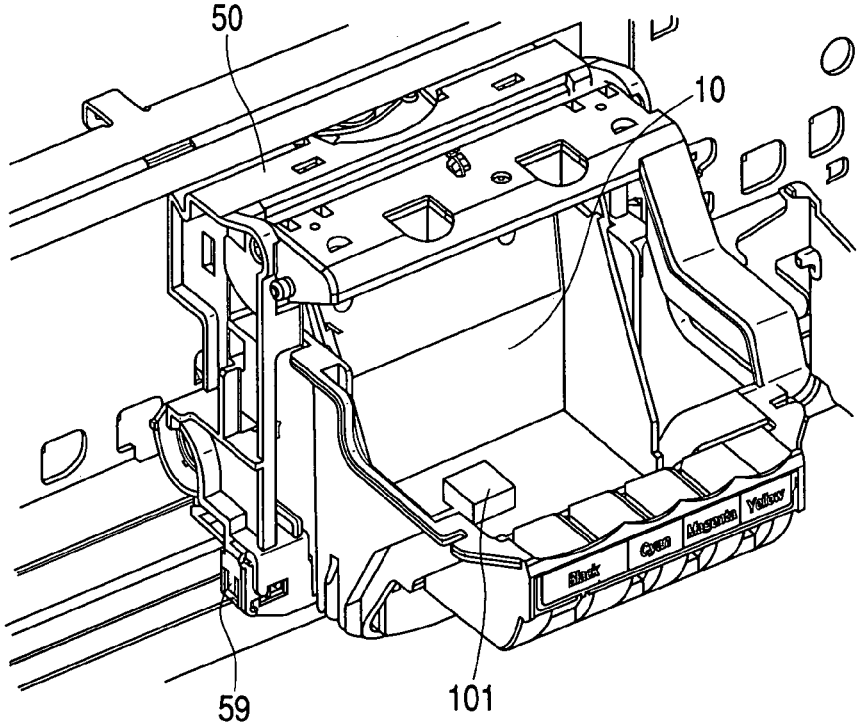

FIGS. 22A and 22B are perspective views of the recording means (recording head) 7 or the adjustment head 10 being mounted to the carriage 50 as the recording means moving means in the first embodiment of the recording apparatus to which the present invention is applied. FIG. 22A shows the carriage 50 to which the recording head 7 is mounted whereas FIG. 22B shows the carriage 50 to which the adjustment head 10 is mounted. As shown in FIG. 22A, the ink tank 71 is set in the recording head 7. In FIG. 22B, the adjustment head 10 replaces the recording head 7 and is mounted in a similar fashion. To elaborate, the adjustment head 10 is shaped like the recording head 7 and, similar to the recording head 7, is attachable to the carriage 50 serving as the recording means moving means. The recording head 7 is electrically connected through the carriage substrate 92 and the contact 921 as mentioned above. Similarly, the adjustment head can be electrically connected to the carriage substrate 92.

Figure 23A:
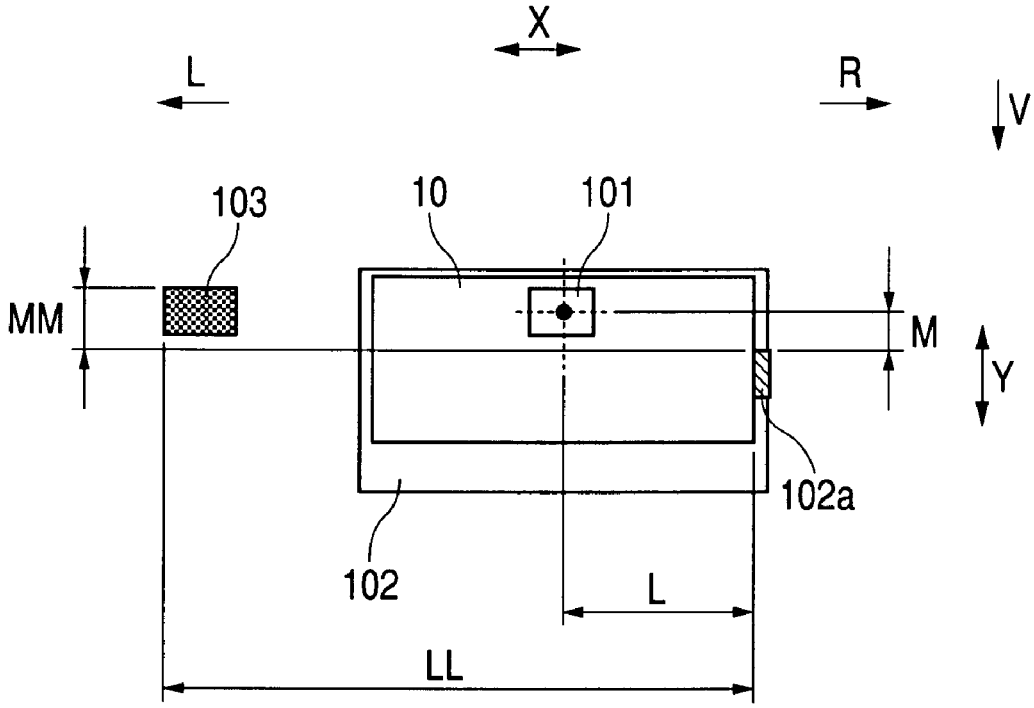
FIGS. 23A and 23B are schematic diagrams illustrating a method of calibrating the adjustment head in FIG. 21 and FIG. 22B.
Figure 23B:
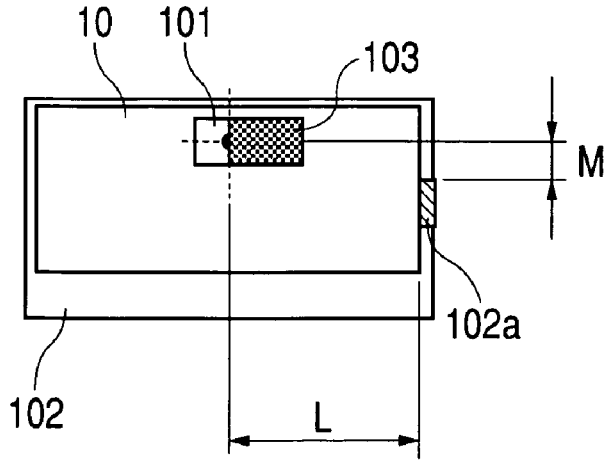

FIGS. 23A and 23B are schematic diagrams illustrating a method of calibrating the adjustment head 10 in FIG. 21 and FIG. 22B in accordance with the first embodiment. As described above, where to attach the tray position detection sensor 59 is measured with the adjustment sensor 101 of the adjustment head 10 as the reference and therefore precise measurement is impossible without positioning the adjustment sensor 101 of the adjustment head 10 correctly. Some errors are unavoidable even when the adjustment sensor 101 and the adjustment head 10 are manufactured with high accuracy. For that reason, this embodiment employs a calibration method in which how far the adjustment sensor 101 deviates from the given position is measured and correction is made for the misalignment.

In FIG. 23A, the adjustment head 10 is mounted to an adjustment head calibration table 102 and is pressed against an adjustment head positioning portion 102*a* by a not-shown spring or the like. Symbol 103 denotes a calibration detection mark and the calibration detection mark 103 is attached to a not-shown table, which is movable in a direction X and in a direction Y in the drawing. The not-shown table may be one having a dial gauge such as an X-Y stage or one driven by a linear motor or the like the position of which is measured by a laser or other meter. The use of such a table makes it possible to measure the distance from the adjustment head positioning portion 102*a* (LL in the direction X and MM in the direction Y) accurately. The adjustment head calibration table 102, the adjustment head positioning portion 102*a*, and the calibration detection mark 103 constitute the calibration means in the present invention.

Starting from the state shown in FIG. 23A, the calibration mark 103 is moved in a direction R and faces the adjustment sensor 101 as shown in FIG. 23B. The adjustment sensor 101 here is a so-called reflective sensor which has a light emitting element and a light receiving element, and light from the light emitting element is reflected at an opposite portion to be received by the light receiving element. The calibration detection mark 103 accordingly has a mirrored surface to make it highly reflective of light. As the calibration detection mark 103 passes the point opposed to the adjustment sensor 101, the sensor detects whether there is reflected light or not. FIG. 23 shows a change from when reflected light is detected to when no reflected light is detected and this is the position of the calibration detection mark 103. At this point, the distance LL (in the direction X) is measured and the measured value is compared to a distance L (in the direction X) of where the adjustment sensor 101 should be. The difference between the two corresponds to the deviation from the predetermined value.

Figure 24:
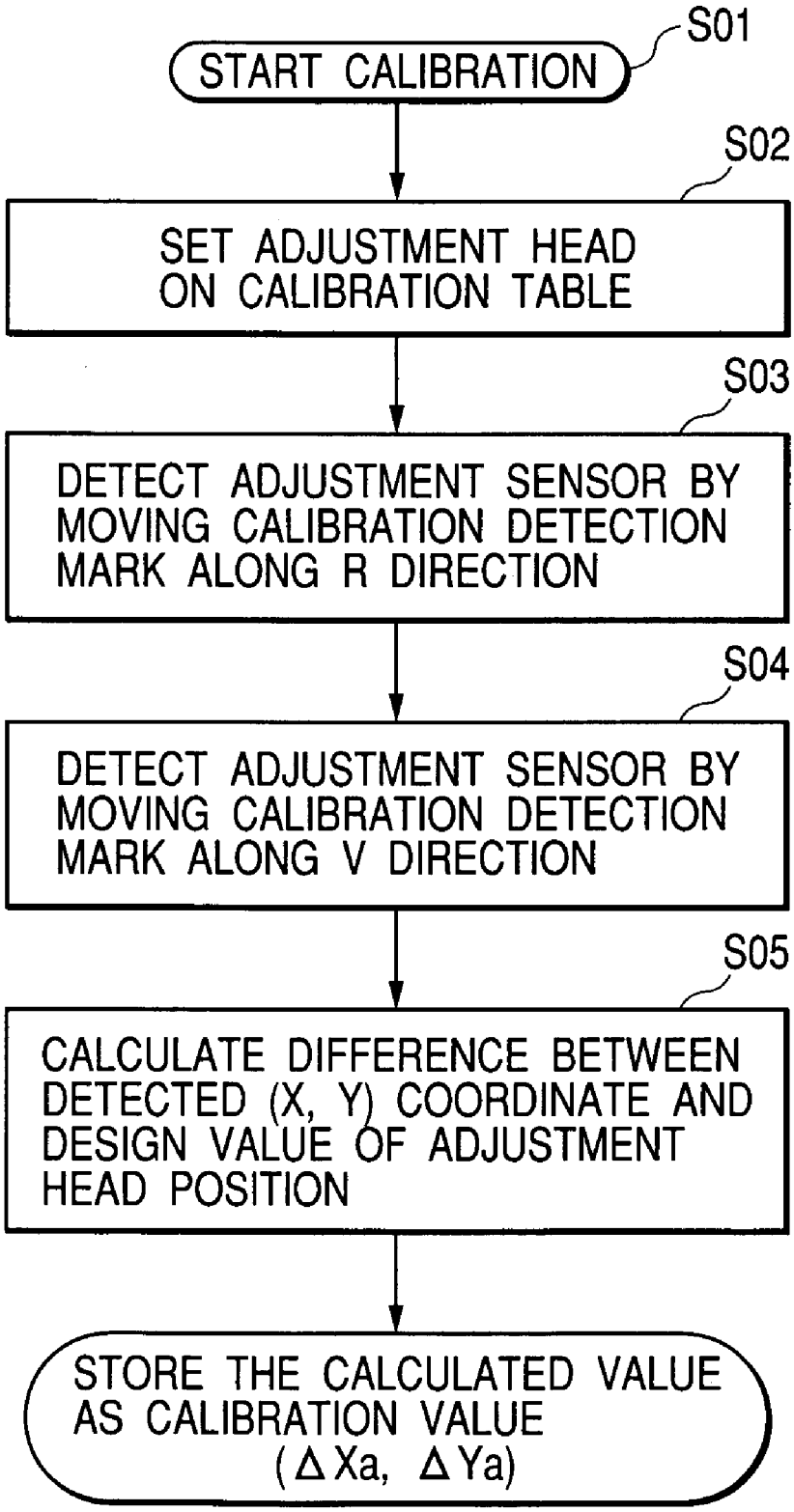
FIG. 24 is a flow chart showing an example of an operation procedure of the method of calibrating the adjustment head in FIG. 21 and FIG. 22B in accordance with the first embodiment of the present invention.
Figure 25:
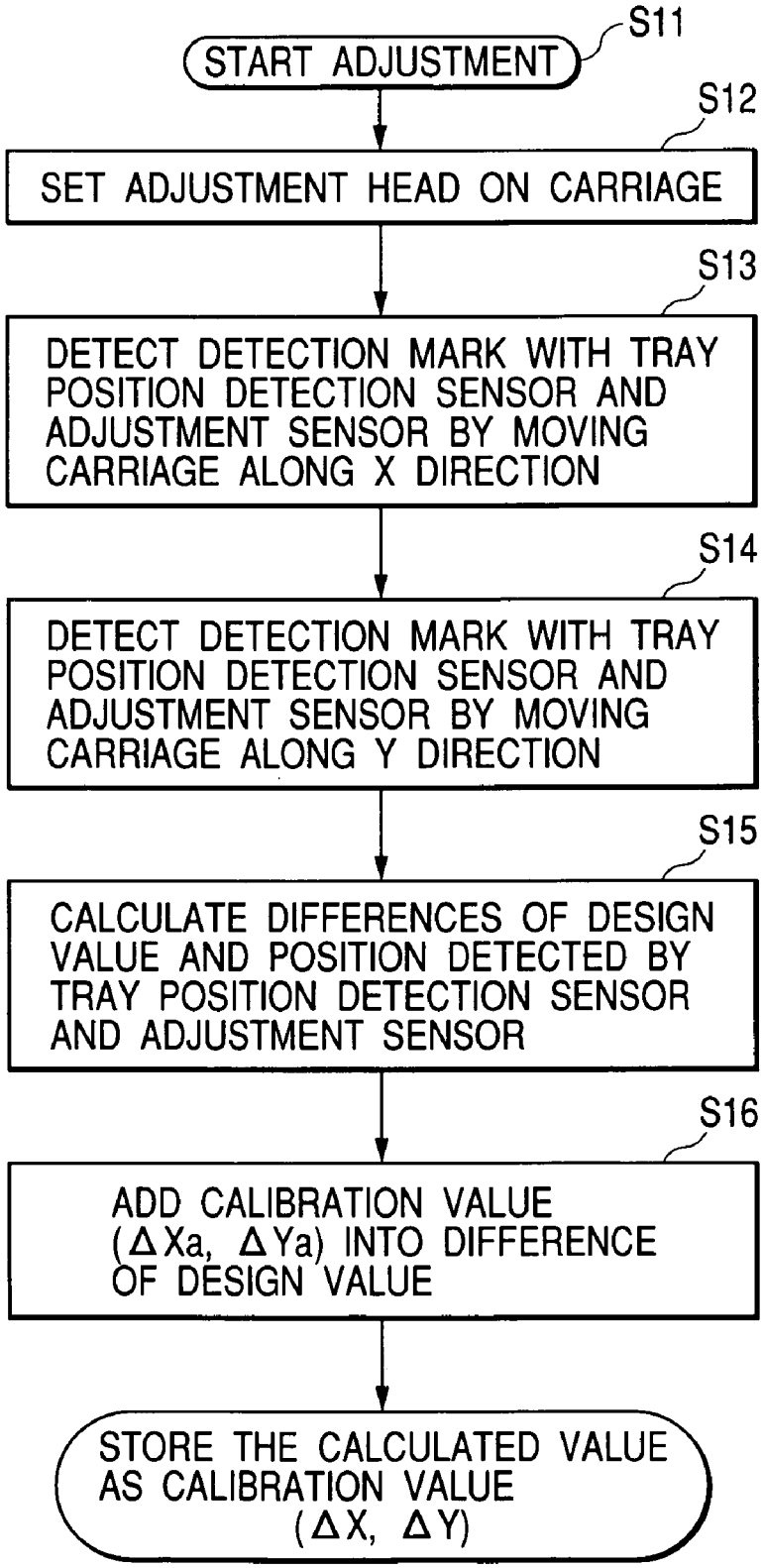
FIG. 25 is a flow chart showing an example of an operation procedure for adjusting the tray position detection sensor on the recording means moving means using the adjustment head that is calibrated by the calibration method in FIG. 24 in accordance with the first embodiment of the present invention.

FIG. 24 is a flow chart showing an example of an operation procedure of a calibration method for the adjustment head 10 in FIG. 21 and FIG. 22B in accordance with the first embodiment. FIG. 25 is a flow chart showing an example of an operation procedure for adjusting the tray position detection sensor 59 on the carriage 50 using the adjustment head 10 that is calibrated by the calibration method according to the first embodiment shown in FIG. 24. Referring to FIGS. 24 and 25, descriptions will be given on the operations of the adjusting means and calibration means in the first embodiment of the recording apparatus to which the present invention is applied, namely, the procedure from calibration of the adjustment head 10 to correction of the tray detection sensor 59. In FIG. 24, the first thing as the calibration is started (Step S01) is to set the adjustment head 10 on the adjustment head calibration table 102 (Step S02). Then the calibration detection mark 103 is moved in the direction R shown in FIGS. 23A and 23B and the predetermined position of the detection mark 103 is detected by the adjustment sensor 101 (Step S03).

Next, the calibration detection mark 103 is moved in the direction of an arrow V shown in FIGS. 23A and 23B and again the predetermined position of the detection mark is detected by the adjustment sensor 101 (Step S04). The position (X, Y) of the calibration detection mark 103 detected in Step S03 and Step S04 is compared to the position where the adjustment sensor 101 should be to calculate the difference between the two (Step S05). The misalignment amount (ΔXa, ΔYa) obtained in Step S05 is stored as a value special to the adjustment head 10, or written down to be consulted later in adjusting the recording head (Step S06).

Described next referring to the flow chart of FIG. 25 is the operation procedure for adjusting the tray position detection sensor 59 on the carriage 50 using the calibrated adjustment head 10. In FIG. 25, as the adjustment is started (Step S11), the adjustment head 10 is set on the carriage 50 (Step S12) and the carriage is moved in the direction X (shown in FIGS. 23A and 23B). Then the tray position detection sensor 59 and the adjustment sensor 101 read the same detection mark (Step S13). As the carriage 50 comes to a stop, the detection mark is moved in the direction Y shown in FIGS. 23A and 23B and again the tray position detection sensor 59 and the adjustment sensor 101 read the same detection mark (Step S14).

Subsequently, the position detected in Step S13 and Step S14 is compared to the positions where the tray position detection sensor 59 and the adjustment sensor 101 should be in relation to each other to calculate the amount of misalignment (Step S15). The adjustment head calibration value (ΔXa, ΔYa) is added to the obtained misalignment amount (Step S16), and the result is stored as a correction value (ΔX, ΔY) for the tray position detection sensor 59 in storing means of the recording apparatus (Step S17). The correction value stored in the storing means of the recording apparatus is used in detecting the tray position detection marks 834 on the tray 83 and recording with the detection result as the reference in the manner described above, and the correct position to record is obtained by adding the correction value when recording. The structure and operation of the first embodiment which are described in the above with reference to FIG. 13 and FIGS. 20 to 25 makes it possible to print on a CD with high accuracy through a simple operation.

Second Embodiment

Figure 26:
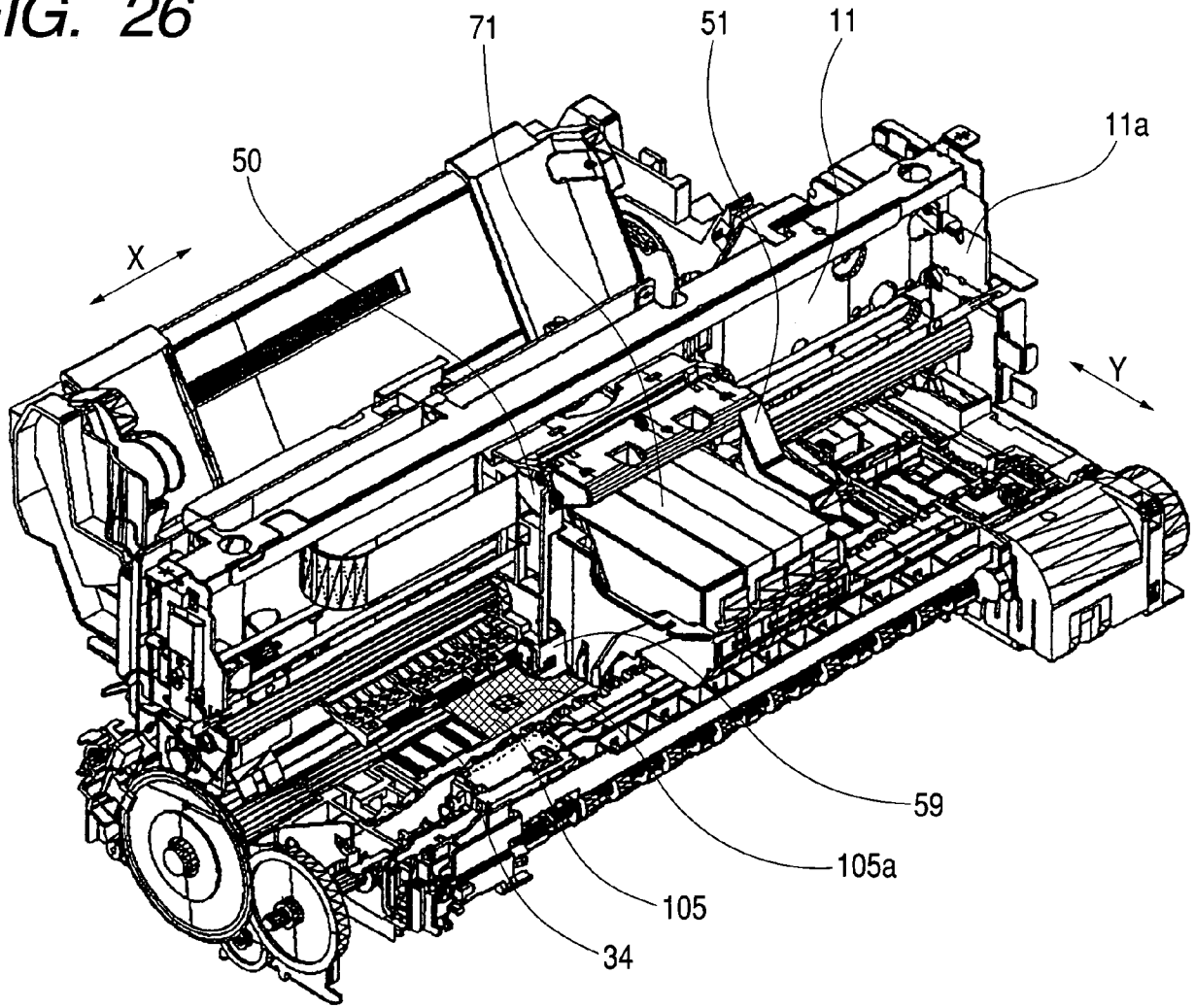
FIG. 26 is a perspective view showing a mechanism adjusting a tray position detection sensor in a second embodiment of a recording apparatus to which the present invention is applied.

FIG. 26 is a perspective view showing a mechanism when adjusting the tray position detection sensor in a second embodiment of the recording apparatus to which the present invention is applied. In the adjusting means of the first embodiment, the position to attach the tray position detection sensor 59 is measured and corrected using the adjustment sensor 101 of the adjustment head 10. The present invention is not limited thereto, and the position of the tray position detection sensor 59 may be adjusted by marking the interior of the recording apparatus with an adjustment detection mark and detecting the mark with the tray position detection sensor 59.

That is, in FIG. 26, a calibration detection mark 105*a* is formed on a calibration detection plate 105, the plate being temporarily attached to the top face of the platen 34 placed at a position opposite to the recording head 7. The calibration detection plate 105 can be placed at a correct position in a direction X and a direction Y shown in FIG. 26 inside the recording apparatus. As described above, the position in the direction X of the carriage 50 as the recording means moving means is obtained by reading the code strip 561 (FIGS. 3 and 4) with the encoder sensor 56 while the carriage 50 is run in the direction X, and the reference thereof is determined by pressing the carriage 50 against a right side plate 11*a* (FIG. 26) of the chassis 11. Accordingly, the calibration detection plate 105 too is attached with the right side plate 11*a* as the reference and the calibration detection mark 103 is placed at a correct distance in the direction X from the right side plate 11*a*. The correct position in the direction Y of the calibration detection plate 105 is obtained by using as the reference the guide shaft 52 which serves as a guide in running the carriage 50 in the direction X. At the same time, this makes it possible to transport the calibration detection plate 105 in the direction Y when gripped between the transport roller 36 and the pinch rollers 37.

In this structure, the carriage 50 is pressed against the right side plate 11*a* of the chassis 11 to set the carriage 50 to the starting position. From that position, the carriage 50 runs in the direction X in FIG. 26 and the tray position detection sensor 59 detects an edge of the calibration detection mark 105*a* of the calibration detection plate 105. If the detected position of the edge of the calibration detection mark 105*a* does not match the predetermined amount, the detected value is used as a correction value in the direction X. The calibration detection mark 105*a* is normally positioned correctly in the direction Y, and the mark is either detected or not at all when the mark is read by the tray position detection sensor 59 while the carriage is run in the direction X. Accordingly, the reading does not show whether the position in the direction Y of an edge of the calibration detection mark 105*a* is correct or not.

If the calibration detection mark 105*a* is detected in the above reading, the calibration detection plate 105 is transported in the direction of the sheet delivery unit 4 to detect an edge of the calibration detection plate 105. On the other hand, if the calibration detection mark 105*a* is not detected in the above reading, the calibration detection plate 105 is transported in the direction of the sheet feeding unit 2 to similarly detect an edge of the calibration detection mark 105*a*. In the case where the detected value does not match the predetermined value as this, the detected value is used as a correction value in the direction Y. The correction values in the directions X and Y calculated as above are stored in a storage device inside the recording apparatus and, similar to the precedent embodiment, are used in recording on a recording medium in the tray 83 with the tray position detection marks 834 (FIG. 13) detected by the tray position detection sensor 59 serving as the reference. The correct position to record is obtained by adding these correction values.

Third Embodiment

Figure 27A:
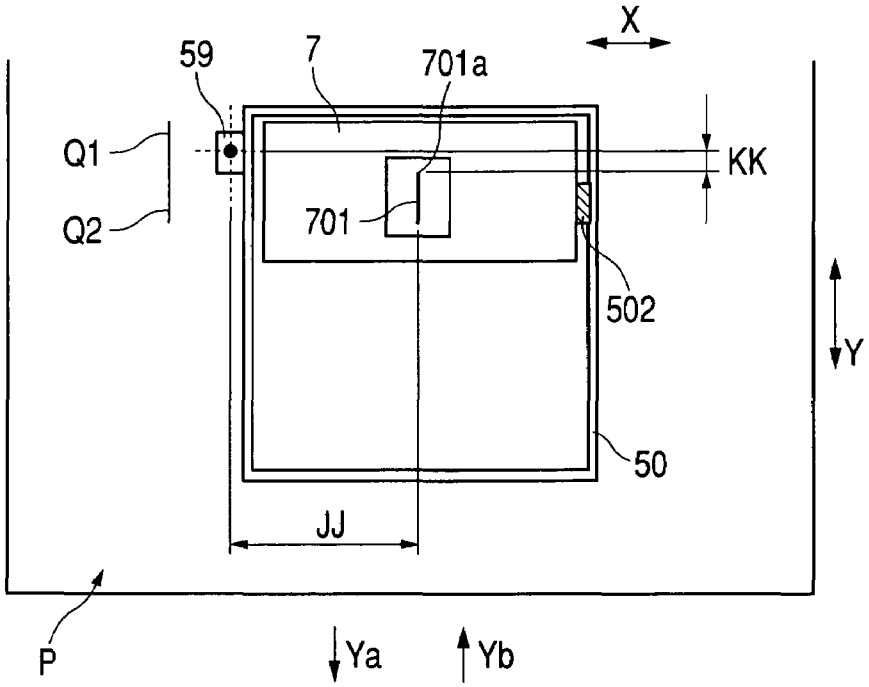
FIGS. 27A and 27B are schematic plan views showing recording means on recording means moving means and a tray position detection sensor in a third embodiment of a recording apparatus to which the present invention is applied.
Figure 27B:
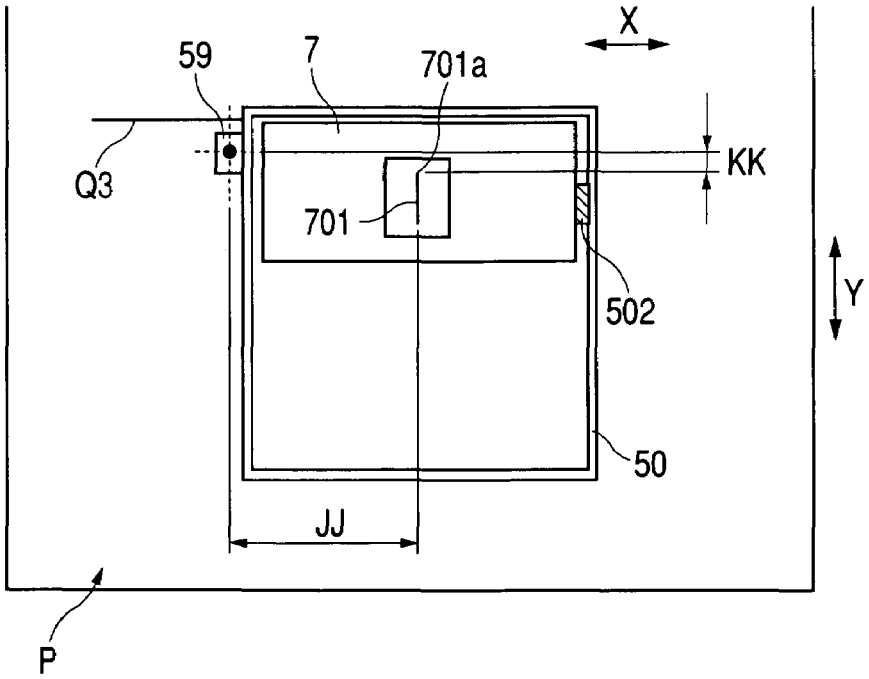

FIGS. 27A and 27B are schematic plan views showing the recording head 7 and the tray position detection sensor 59 on the carriage 50 in a third embodiment of the recording apparatus to which the present invention is applied. In the first and second embodiments, the position where the tray position detection sensor 59 mounted on the carriage 50 is attached is detected and corrected. The present invention is not limited thereto and, if the recording head 7 and the tray position detection sensor 59 can be mounted onto the carriage 50 at the same time, the correction may be made by reading an image which has been recorded by the recording head 7 with the tray position detection sensor 59. In FIGS. 27A and 27B, the recording head 7 and the tray position detection sensor 59 are mounted to the carriage 50 at the same time and the tray position detection sensor 59 reads an image that has been recorded by the recording head 7.

FIG. 27A shows adjustment of the position in the direction X. After a single, longitudinal line Q1 is recorded using the discharge port 701 of the recording head, a recording sheet P is transported in a direction Yb by one line and then the second longitudinal line, which is denoted by Q2, is similarly recorded. In this state, the carriage 50 is let run in the direction X so that the longitudinal line Q1 is detected by the tray position detection sensor 59. As described above, the position of the carriage 50 from the reference can be detected by reading the code strip 561 with the encoder sensor 56 that is mounted to the carriage. The position of the carriage 50 when the recording head records the longitudinal line is compared to the position of the carriage 50 when the same longitudinal line is detected by the tray position detection sensor 59 to calculate the difference between the two. If the calculated value does not match the predetermined value, the difference between the calculated and predetermined values corresponds to the amount of misalignment and the misalignment is corrected.

FIG. 27B shows adjustment of the position in the direction Y. After a single, lateral line Q3 is recorded using one of the ports of the discharge port 701 of the recording head 7, the carriage 50 is moved in the direction X until it reaches a point on the lateral line Q3 that is opposite to the tray position detection sensor 59. Then the recording sheet P is transported in the direction Yb and the tray position detection sensor 59 detects the lateral line Q3. At this point, how far the recording sheet P has been transported in the direction Yb before the tray position detection sensor 59 detects the lateral line Q3 is detected. If the transportation amount does not match an offset amount KK of the discharge port 701 and the tray position detection sensor 59, the difference between the two corresponds to the amount of misalignment and is used as a correction value. Reading a recorded image with the tray position detection sensor 59 for calculation of the difference from the predetermined amount in this manner makes it possible to grasp the amount of misalignment of the discharge port and the tray position detection sensor 59.

Similar to the previous embodiments, the thus obtained correction value is used in recording on a recording material in the tray with the tray position detection marks 834 (FIG. 13) detected by the tray position detection sensor 59 serving as the reference, and the correct position to record is obtained by adding the correction value.

The descriptions given in the above embodiments take as an example the case where the recording apparatus is an ink jet recording apparatus. However, the present invention is similarly applicable to the recording apparatus of other recording methods, such as a wire dot method, a thermal method, and a laser beam method, while providing similar effects. Also, the present invention can be applied, in a similar manner, with similar effects, to a recording apparatus for monochrome recording, a color recording apparatus which uses one or more recording heads to record an image in various colors, a gradation recording apparatus for recording an image in one color but in gradations, and a recording apparatus which is a combination of the above.

The descriptions given in the above embodiments take as an example the case of employing a serial recording apparatus which records an image while a recording head as recording means is moved in the main scanning direction. However, it is sufficient for the present invention if a recording apparatus has recording means moving means that moves recording means in the direction that crosses the recording material transporting direction. The present invention is therefore not limited to a serial recording apparatus which uses the main scanning carriage 50 as the recording means moving means. The present invention is similarly applicable to a recording apparatus of other recording methods, such as a line recording method (line type recording apparatus) in which a linear recording head long enough to partially or entirely cover the width of a recording material is used to record an image solely by sub-scanning, while providing similar effects.

In addition, the present invention can be applied, in a similar manner, with similar effects, to an ink jet recording apparatus which uses liquid ink irrespective of arrangement of a recording head and an ink tank. Examples of the arrangement include one employing an exchangeable head cartridge in which a recording head and an ink tank are integrated, and one in which a recording head and an ink tank are separated from each other and are connected to each other by an ink supplying tube or the like. The present invention is also applicable to an ink jet recording apparatus whose recording means uses an electromechanical transducer such as a piezoelectric element, and provides particularly excellent effects when applied to an ink jet recording apparatus having recording means that utilizes heat energy to jet ink. This is because the recording method makes it possible to achieve recording of increased density and definition.

What is claimed is:

1. A recording apparatus for recording on a recording material with recording means, comprising:

a carriage unit, including a carriage that moves relative to the recording material, with the carriage mounting the recording means, which records an image on the recording material, and an adjustment head that includes an adjustment sensor; and a detection sensor provided on the carriage, to detect a position of the recording material wherein an offset amount is determined between a detected position detected by said detection sensor and a correct position by reading a common mark with said adjustment sensor and said detection sensor, and said recording means records an image at a corrected position on the recording material based on the determined offset amount.

2. A recording apparatus according to claim 1, wherein said detection sensor detects a detection mark provided on a tray to mount and convey a recording material.

3. A recording apparatus according to claim 2, wherein the recording material is a compact disk.

4. A recording apparatus according to claim 1, further comprising correction means for performing a correction of the recording at the corrected position.

5. A recording apparatus according to claim 1, wherein said recording means is a recording head to discharge an ink onto the recording material.

* * * * *

UNITED STATES PATENT AND TRADEMARK OFFICE

CERTIFICATE OF CORRECTION

PATENT NO. : 7,325,898 B2
APPLICATION NO. : 10/607341
DATED : February 5, 2008
INVENTOR(S) : Kenji Kawazoe et al.

It is certified that error appears in the above-identified patent and that said Letters Patent is hereby corrected as shown below:

COLUMN 1:

Line 48, “while” should read --white--.

COLUMN 6:

Line 7, “(fed).” should read --(fed)--.

COLUMN 15:

Line 6, “of” should read --on--.

Signed and Sealed this

Tenth Day of February, 2009

John Doll

JOHN DOLL
*Acting Director of the United States Patent and Trademark Office*